US011229286B2

(12) United States Patent
Andersson

(10) Patent No.: US 11,229,286 B2
(45) Date of Patent: Jan. 25, 2022

(54) DRAWER, AND A DRAWER SLIDING SYSTEM FOR SUCH DRAWER

(71) Applicant: IKEA Supply AG, Pratteln (CH)

(72) Inventor: Benny Andersson, Almhult (SE)

(73) Assignee: IKEA Supply AG, Pratteln (CH)

( * ) Notice: Subject to any disclaimer, the term of this patent is extended or adjusted under 35 U.S.C. 154(b) by 306 days.

(21) Appl. No.: 15/757,535

(22) PCT Filed: Sep. 7, 2016

(86) PCT No.: PCT/EP2016/071104
§ 371 (c)(1),
(2) Date: Mar. 5, 2018

(87) PCT Pub. No.: WO2017/042228
PCT Pub. Date: Mar. 16, 2017

(65) Prior Publication Data

US 2018/0338615 A1 Nov. 29, 2018

(30) Foreign Application Priority Data

Sep. 7, 2015 (SE) ..... 1551138-9
Jul. 13, 2016 (SE) ..... 1651049-7
Jul. 25, 2016 (SE) ..... 1651084-4

(51) Int. Cl.
*A47B 88/49* (2017.01)
*A47B 88/483* (2017.01)
(Continued)

(52) U.S. Cl.
CPC ..... *A47B 88/49* (2017.01); *A47B 88/402* (2017.01); *A47B 88/467* (2017.01);
(Continued)

(58) Field of Classification Search
CPC ..... A47B 88/40; A47B 88/483; A47B 88/12; A47B 88/49; A47B 88/08; A47B 88/497;
(Continued)

(56) References Cited

U.S. PATENT DOCUMENTS 1,071,006 A 8/1913 Little
2,441,721 A 5/1948 Schroeder
(Continued)

FOREIGN PATENT DOCUMENTS

CA 2 437 147 A1 2/2005
CA 2215925 C 9/2008
(Continued)

OTHER PUBLICATIONS

Loehle et al. "Mixed Lubrication with C18 Fatty Acids: Effect of Unsaturation", Tribology Letters, 2014, vol. 53, pp. 319-328.
(Continued)

*Primary Examiner* — Andrew M Roersma
(74) *Attorney, Agent, or Firm* — Renner, Otto, Boisselle & Sklar, LLP

(57) ABSTRACT

A sliding system for a drawer is provided. The sliding system includes at least two parts being moveable relative each other and adapted for together forming a connection between the drawer and an associated cabinet, wherein one of said at least two parts includes at least one sliding surface being coated with a lacquer including a resin, wherein said lacquer in turn is at least partly coated with a lipophilic composition coating to provide a slide layer with a lowered friction.

20 Claims, 16 Drawing Sheets

(51) Int. Cl.
*A47B 88/467* (2017.01)
*A47B 88/40* (2017.01)
*C10M 107/32* (2006.01)

(52) U.S. Cl.
CPC ..... *A47B 88/483* (2017.01); *C10M 107/32* (2013.01); *A47B 2210/0029* (2013.01); *A47B 2210/0056* (2013.01); *A47B 2210/0059* (2013.01)

(58) Field of Classification Search
CPC ..... A47B 88/402; A47B 88/0455; A47B 2210/00; A47B 2210/0002; A47B 2210/0029; A47B 2220/008; A47B 88/467; A47B 2210/0056; A47B 2210/0059; C10M 107/32
See application file for complete search history.

(56) References Cited

U.S. PATENT DOCUMENTS

| | | | | |
|---|---|---|---|---|
| 2,720,316 | A | 10/1955 | Glascott | |
| 3,139,313 | A | 6/1964 | Rule | |
| 3,221,677 | A | 12/1965 | Kerr | |
| 3,457,676 | A | 9/1967 | Ziegler | |
| 3,457,677 | A | 10/1967 | Ziegler | |
| 3,615,144 | A | 10/1971 | Plemeng | |
| 3,622,473 | A | 11/1971 | Ohta et al. | |
| 3,755,093 | A | 8/1973 | Suematsu | |
| 3,760,744 | A | 9/1973 | Cruckshank | |
| 3,916,802 | A | 11/1975 | Virtue | |
| 4,036,369 | A | 7/1977 | Eisenberg | |
| 4,138,176 | A * | 2/1979 | Cowdroy ..... | A47B 88/483 312/334.16 |
| 4,286,525 | A | 9/1981 | Willmore | |
| 4,297,952 | A | 11/1981 | Zagaroli | |
| 4,500,146 | A | 2/1985 | Peterson | |
| 4,637,081 | A | 1/1987 | Clark | |
| 4,713,949 | A | 12/1987 | Wilcox | |
| 4,868,935 | A | 6/1989 | Weelden | |
| 5,064,547 | A | 11/1991 | Rubin | |
| 5,085,524 | A | 2/1992 | Reiss, Jr. | |
| 5,101,524 | A | 4/1992 | Brandschain | |
| 5,171,622 | A | 12/1992 | Wegner | |
| 5,263,384 | A | 11/1993 | Motohiko | |
| 5,290,058 | A | 3/1994 | Adams et al. | |
| 5,325,732 | A | 7/1994 | Vogel | |
| 5,735,610 | A | 4/1998 | Mark et al. | |
| 5,981,448 | A | 11/1999 | Matsui et al. | |
| 5,992,496 | A | 11/1999 | Lee | |
| 6,004,909 | A | 12/1999 | Lindman | |
| 6,225,404 | B1 | 5/2001 | Sorensen et al. | |
| 6,520,092 | B2 | 2/2003 | Marshall | |
| 6,822,014 | B2 | 11/2004 | Katou | |
| 6,854,402 | B2 | 2/2005 | Dubarry | |
| 6,855,676 | B2 | 2/2005 | Li | |
| 6,877,826 | B2 | 4/2005 | Wood | |
| 7,398,737 | B1 | 7/2008 | Martellaro | |
| 7,653,966 | B2 | 2/2010 | Quinn | |
| 7,780,254 | B2 | 8/2010 | Wang | |
| 7,987,799 | B2 | 8/2011 | Lange | |
| 8,418,318 | B2 | 4/2013 | Scharf et al. | |
| 9,532,659 | B2 | 1/2017 | Tsui et al. | |
| 10,077,934 | B1 | 9/2018 | Dizon | |
| 2003/0013615 | A1 | 1/2003 | Levy | |
| 2003/0213698 | A1 | 11/2003 | Kawagoshi et al. | |
| 2004/0096129 | A1 | 5/2004 | Schmalzhofer | |
| 2006/0231218 | A1 | 10/2006 | Liang | |
| 2007/0261198 | A1 | 11/2007 | Vogler | |
| 2008/0125338 | A1 | 5/2008 | Corbett et al. | |
| 2008/0159671 | A1 | 7/2008 | Leonardelli | |
| 2011/0177987 | A1 | 7/2011 | Lentig | |
| 2012/0240350 | A1 | 9/2012 | Natu et al. | |
| 2014/0157677 | A1 | 6/2014 | Walawender et al. | |
| 2014/0208654 | A1 | 7/2014 | Anderson | |
| 2014/0255656 | A1 | 9/2014 | Suzuki et al. | |
| 2015/0361274 | A1 | 12/2015 | Domes et al. | |
| 2016/0106221 | A1 | 4/2016 | Gardner | |
| 2016/0319211 | A1 | 11/2016 | Barth et al. | |
| 2019/0017306 | A1 | 1/2019 | Romero et al. | |
| 2020/0003258 | A1 | 1/2020 | Andersson | |

FOREIGN PATENT DOCUMENTS

| | | | |
|---|---|---|---|
| CH | 334 983 | A | 12/1958 |
| CN | 1090593 | A | 8/1994 |
| CN | 1223675 | | 7/1999 |
| CN | 2481814 | Y | 3/2002 |
| CN | 1385482 | | 12/2002 |
| CN | 2542785 | Y | 4/2003 |
| CN | 101035959 | A | 9/2007 |
| CN | 201079158 | Y | 7/2008 |
| CN | 201190490 | U | 2/2009 |
| CN | 201230725 | Y | 5/2009 |
| CN | 201491997 | U | 6/2010 |
| CN | 102307499 | A | 1/2012 |
| CN | 202128137 | U | 2/2012 |
| CN | 202436824 | U | 9/2012 |
| CN | 103555177 | A | 2/2014 |
| CN | 103573075 | A | 2/2014 |
| CN | 103867062 | | 6/2014 |
| CN | 104154118 | A | 11/2014 |
| DE | 1112266 | B | 8/1961 |
| DE | 1954506 | | 5/1971 |
| DE | 3613313 | A1 | 10/1987 |
| DE | 29611949 | U1 | 9/1996 |
| DE | 29813478 | U1 | 11/1998 |
| DE | 19924642 | C2 | 5/1999 |
| DE | 20111930 | U1 | 10/2001 |
| DE | 10 2011 053 946 | A1 | 3/2013 |
| EP | 985793 | A2 | 3/2000 |
| EP | 1153560 | A2 | 11/2001 |
| EP | 1568299 | B1 | 8/2005 |
| EP | 2957784 | | 8/2014 |
| EP | 2957784 | A1 | 12/2015 |
| FR | 1467583 | A | 1/1967 |
| FR | 2254222 | | 7/1975 |
| GB | 1126855 | A | 9/1968 |
| GB | 1383645 | | 2/1975 |
| GB | 1415100 | A | 11/1975 |
| GB | 2 386 929 | A | 10/2003 |
| JP | 57173666 | A | 10/1982 |
| JP | 576447 | | 3/1993 |
| JP | H06136304 | | 5/1994 |
| JP | 2003268194 | | 9/2003 |
| JP | 2005042304 | A | 2/2005 |
| JP | 2006-062328 | A | 3/2006 |
| SU | 1690664 | A1 | 11/1991 |
| WO | 9424912 | A1 | 11/1994 |
| WO | 1999047824 | A1 | 9/1999 |
| WO | 2006022669 | A1 | 3/2006 |
| WO | 2015051892 | A1 | 4/2015 |
| WO | 2017042201 | A1 | 3/2017 |
| WO | 2017042203 | A1 | 3/2017 |
| WO | 2017044032 | A1 | 3/2017 |
| WO | 2017044034 | A1 | 3/2017 |
| WO | 2018160127 | | 9/2018 |

OTHER PUBLICATIONS

Greenlaw, "I use coconut oil instead of a spray lubricant as much as possible, especially near food", Pi nterest 11I, 1' Nov. 2014 (Nov. 1, 2014)' XP055315462, Retrieved from the Internet: URL:https:ijnl.pinterest.com/pin/395331673512857041/[retrieved on 20:1.6-11-01].

International Search Report and Written Opinion for copending International Application No. PCT/EP2016/071065 dated Nov. 14, 2011.

International Preliminary Report on Patentability copending International Application No. PCT/EP2016/071065 dated Oct. 12, 2017.

(56) References Cited

OTHER PUBLICATIONS

International Search Report and Written Opinion for corresponding International Application No. PCT/EP2016/071104 dated Nov. 16, 2011.
International Preliminary Report on Patentability corresponding International Application No. PCT/EP2016/071104 dated Oct. 12, 2017.
International Search Report and Written Opinion for copending International Application No. PCT/SE2016/050837 dated Nov. 23, 2016.
International Preliminary Report on Patentability copending International Application No. PCT/SE2016/050837 dated Oct. 13, 2017.
International Search Report and Written Opinion for copending International Application No. PCT/SE2016/050835 dated Nov. 23, 2016.
International Search Report and Written Opinion for copending International Application No. PCT/EP2016/071059 dated Dec. 5, 2016.
Štěpek et al. Additives for Plastics, Polymers Properties and Applications 5, Prague and Montreal, Dec. 1982.
Hussein et al., "Enhancement of the Wear Resistance and Microhardness of Aluminum Alloy by Nd:YaG Laser Treatment," The Scientific World Journal,, vol. 2014,Article ID 842062, pp. 1-5.
Table of Aluminum hardnesses—Nov. 29, 2019 (Year:2019).
Roleira, F M F et al, Lipophilic phenolic antioxidants: Correlation between antioxidant profile, partition coefficients and redox properties, Bioorganic & Medicinal Chemistry, Elsevier, ML, vol. 18, No. 16, Aug. 15, 2010, pp. 5816-5825.
M.J. Furey et al, The Effect of Lubriccant Viscosity on Metallic Contact and Friction in a Sliding System, vol. 5, No. 1, Jan. 1, 1962, pp. 149-159, XP055745398.
Anonymous, Standard Test Method for Total Iodine Value of Drying Oils and Their Derivatives (D 1541-97), withdrawn, Jan. 1, 1997, pp. 1-4, XP055745437, retrieved from the internet: www.astm.org on Oct. 30, 2020.
Anonymous, Regulation (EC) No. 1935/2004 of the European Parliament And of the Council of Oct. 27, 2004 on materials and articles intended to come into contact with food and repealing Directives 80/590/EEC and 89/109/EEC, Official Journal of the European Union, Nov. 13, 2004, pp. 1-14, XP055745458.
Anonymous, Liquid Petroleum or "Russian Mineral Oil", Journal of Pharmaceutical Sciences, vo. 3, No. 7, Jul. 1, 1914, pp. 1013-1018, XP055745484, ISSN: 0898-140X, DOI: 10.1002/jps.3080030718.

* cited by examiner

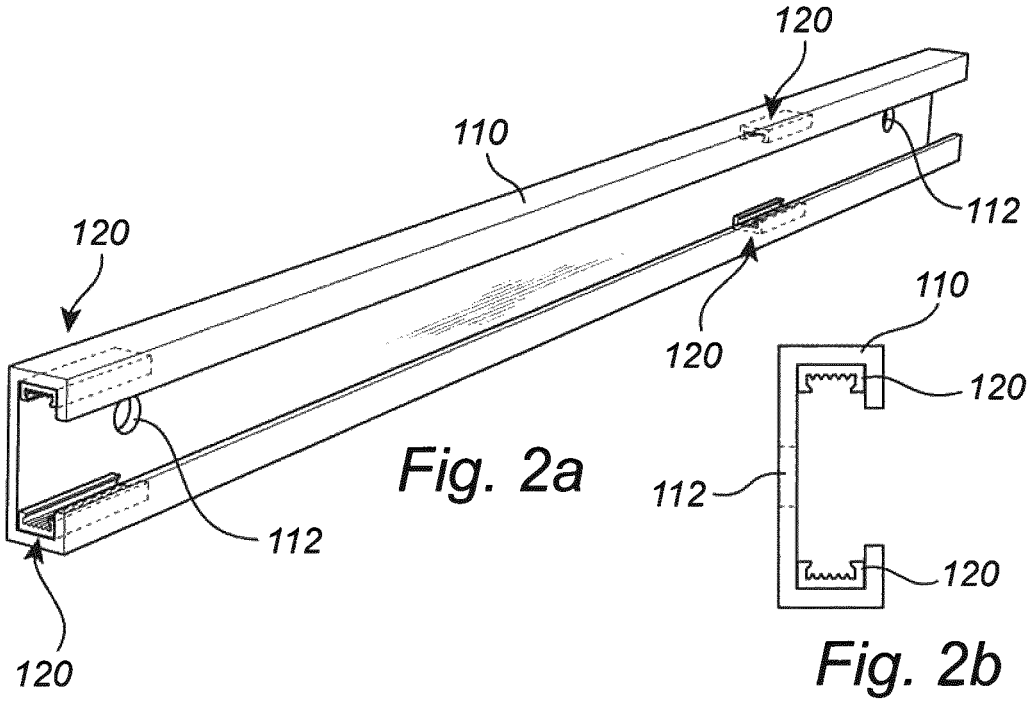
Fig. 2a
Fig. 2b
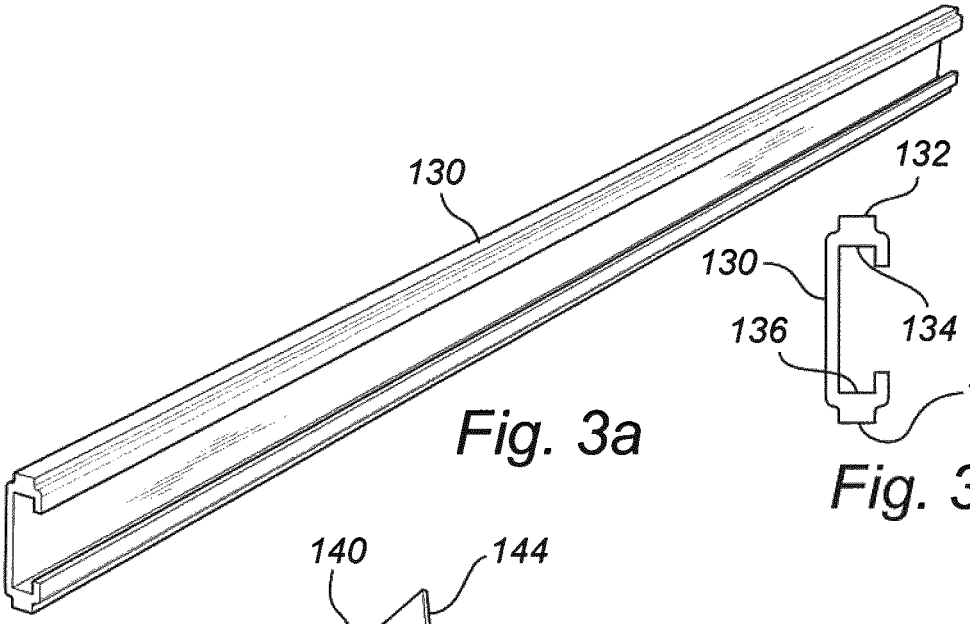
Fig. 3a
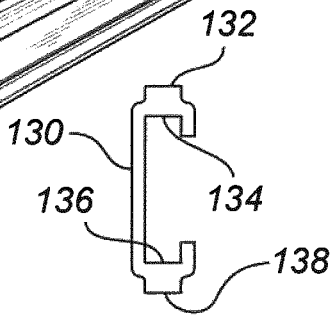
Fig. 3b
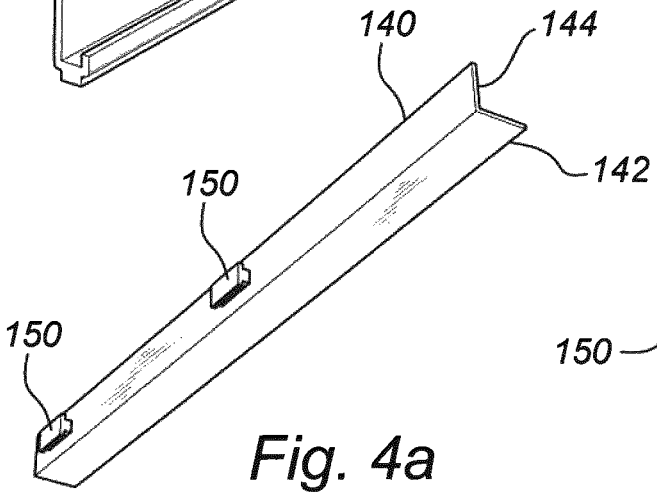
Fig. 4a
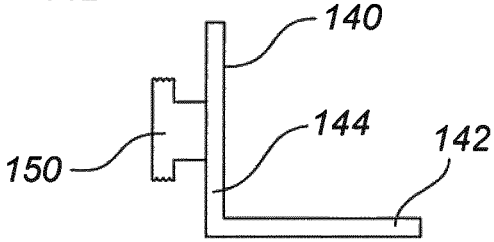
Fig. 4b

DRAWER, AND A DRAWER SLIDING SYSTEM FOR SUCH DRAWER

This application is a national phase of International Application No. PCT/EP2016/071104 filed Sep. 7, 2016, and claims priority to Swedish Application No. 1551138-9 filed on Sep. 7, 2015, Swedish Application No. 1651084-4 filed on Jul. 25, 2016, and Swedish Application No. 1651049-7 filed on Jul. 13, 2016, which are incorporated herein by reference.

TECHNICAL FIELD

The present invention relates to a drawer. More particularly the present invention relates to a drawer sliding system adapted for use with a drawer, as well as a drawer having such drawer sliding system.

BACKGROUND

Drawers have existed for a long time and various techniques have been suggested in order to provide for a robust, yet easily maneuverable, solution allowing the drawer to be drawn out horizontally from an associated cabinet.

A chest of drawers thus typically includes a fixed frame structure in the form of a cabinet, and several drawers which may be individually drawn out from the cabinet in a horizontal direction. The in and out movement of the drawers is normally enabled by a guiding system. In a most simple variant the guiding system is simply horizontal bars on a respective inner wall of the cabinet, protruding into mating recesses in each side wall of the drawer.

For a more smooth movement, it has been suggested to provide the guiding system as a telescopic guiding system in which one guide rail is fixedly mounted to the cabinet, while another guide rail is fixedly mounted to the drawer. The guide rails are moveable relative each other in a telescopic manner by means of one or more rollers, whereby not only a very low friction is ensured, but also it is possible to add stop members such that the drawer does not fall out from the cabinet. Such solutions are well known within the technical area, but they all share the same drawback that rather expensive components, i.e. metal rails, bearings, and low friction rollers, are required to provide the desired functionality.

In view of the problem mentioned there is a need for an improved drawer sliding system for a drawer which allows for a simple and cost effective structure and manufacturing, while still allowing for easy and robust operation.

SUMMARY

An object of the present invention is to provide a drawer sliding system for a drawer overcoming the above mentioned drawbacks of prior art and at least partly solving the problems associated with the prior art systems.

This object is achieved by utilizing a novel concept for drawer sliding systems, and to provide a drawer operating according to this concept. The novel concept is based on the principle of having a sliding surface with very low sliding friction. The sliding surface is coated with a lacquer comprising a resin. The lacquer is in turn at least partly coated with a lipophilic composition coating to provide a slide layer with lowered friction.

The sliding surface may for example be formed on an aluminum bar, e.g. aluminum profile. The aluminum bar may have an anodized oxide surface layer onto which the lacquer is applied. As an example, the sliding surface may be formed on a linear, preferably anodized, aluminum profile having been electrophoretically, preferably anaphoretically coated with an acrylic resin and subsequently heat cured to form the lacquer coated on the slide surface. The Honny process or one of its derivatives may be used to obtain such anodized, lacquered surfaces. Whereas the thickness of the anodized oxide surface layer preferably is at least 5 micrometers, the thickness of the lacquer coated on the slide bar may preferably be 100 micrometers or less. The lipophilic composition coating typically comprises compounds comprising C6 to C40, such as C8 to C30, non-aromatic hydrocarbyl groups, such as alkenyl groups and/or alkyl groups, e.g. alkyl groups.

According to another embodiment the slide surface of the slide member is made from steel, onto which the lacquer is applied. Steel is a generally strong, hard and comparably cheap material that can be used as a starting material for the slide member. Steel surfaces may be lacquered by electrocoating or autodeposition to provide a lacquer layer with uniform thickness.

The linear slide bar is arranged to be in sliding engagement with at least one sliding member. The interface between the slide layer of the slide bar and the sliding member forms a linear plain bearing to allow for linear movement of the sliding member along the longitudinal axis of the linear slide bar. The part of said sliding member to slide over the slide layer may be configured as a protrusion having the form of a blade extending in the sliding direction. Further, the slide layer may be present in a groove extending along the longitudinal axis of the slide bar. The sliding member comprises at least one individual contact point in contact with the slide bar at the interface between the slide bar and the sliding member. The contact area of each individual contact point may be less than 3 $mm^2$. Further, the contact pressure in the at least one contact point may be at least 4 $N/mm^2$.

According to a first aspect of the invention, a drawer sliding system for a drawer is provided. The drawer sliding system comprises at least two parts being moveable relative each other and adapted for together forming a connection between the drawer and an associated cabinet. One of said at least two parts comprises at least one sliding surface being coated with a lacquer comprising a resin, wherein said lacquer in turn is at least partly coated with a lipophilic composition coating to provide a slide layer with a lowered friction.

The sliding surface may preferably be provided on a rigid member having a fastening arrangement adapted for connection to one of said parts being moveable relative each other for allowing linear movement of said part along a longitudinal axis.

In an embodiment the sliding surface is formed on a guiding rail, said guiding rail forming one of said at least two parts.

The guiding rail may be provided with at least two opposite sliding surfaces located at a vertical distance therebetween.

In an embodiment the sliding surface is formed by an intermediate slide bar providing a sliding movement in relation to at least one guiding rail, said guiding rail forming one of said at least two parts.

The sliding surface may be formed in a C-shaped groove in one of said at least two parts.

The sliding surface may be formed on a protruding member having at least one of an upper sliding surface, a lower sliding surface, and a distal sliding surface.

The other one of said parts may be provided with at least one sliding member, and the interface between the sliding surface and the at least one sliding member may form a linear plain bearing to allow for linear movement of the sliding member along the longitudinal axis of the sliding surface.

At least the part of said at least one sliding member being in contact with the sliding surface may be made of a plastic, preferably a plastic comprising a polymer with polar groups, more preferably the polar groups are selected from the group consisting of hydroxyl groups, carboxylic acid groups, amide groups, halide groups, sulfide groups, cyano groups (nitrile groups), carbamate groups, aldehyde groups, and/or ketone groups.

At least the part of said at least one sliding member in contact with the sliding surface may be made of a plastic comprising a polymer selected from the group of polymers consisting of polyoxymethylenes (POM), polyesters (e.g. thermoplastic polyesters, such as polyethylene terephthalate (PET), polytrimethylene terephthalate (PTT), polybutylene terephthalate (PBT), and polylactic acid (PLA), as well as bio-based thermoplastic polyesters, such as polyhydroxyalkanoates (PHA), polyhydroxybutyrate (PHB), and polyethylene furanoate (PEF)), polyamides (PA), polyvinyl chloride (PVC), polyphenylene sulfide (PPS), polyaryletherketone (PAEK; e.g. Polyether ether ketone (PEEK)), and Polytetrafluoroethylene (PTFE).

The at least one sliding member may in its entirety be made from a plastic.

The part of said at least one sliding member to slide over the sliding surface may be configured as a blade extending in the sliding direction and the sliding surface may be present on a guiding rail forming one of the at least two parts of the frame structure, preferably the length of the blade, as seen along the sliding direction of the guiding rail, being 2-50 mm, more preferably 5-30 mm.

The at least one sliding member may comprise at least one individual contact point in contact with the sliding surface, the contact area of each individual contact point being less than 3 $mm^2$, more preferably less than 1.5 $mm^2$, and most preferably less than 0.75 $mm^2$.

The at least one sliding member may comprise at least one contact point at which contact is made between the sliding member and the sliding surface, and the contact pressure in said at least one contact point may be at least 4 $N/mm^2$, preferably at least 8 $N/mm^2$, and more preferably at least 12 $N/mm^2$. Preferably the contact pressure is lower than the strain at yield of the material of the sliding member at the contact point.

The at least two parts being moveable relative each other comprises a first guiding rail being attached to an inner wall of a cabinet, and a second guiding rail being attached to the drawer.

The sliding system may further comprise an intermediate slide bar being movable relative to the first and second guiding rails.

The intermediate slide bar may be provided with a first sliding surface being in sliding contact with a first slide member on the first guide rail and a second sliding surface being in sliding contact with a second slide member on the second guide rail, and/or it may be provided with a first slide member being in sliding contact with a first sliding surface on the first guide rail and a second sliding member being in sliding contact with a second sliding surface on the second guiding rail. Furthermore, the intermediate slide bar may be provided with a first sliding surface being in sliding contact with a first slide member on the first guide rail and a second slide member being in sliding contact with a second sliding surface on the second guiding rail, or the intermediate slide bar is provided with a first slide member being in sliding contact with a first sliding surface on the first guide rail and a second slide member being in sliding contact with a second sliding surface on the second guiding rail.

One of said at least two parts may be a guiding rail being provided with the sliding surface, the other of said at least two parts being the slide member, wherein the guiding rail is provided with a groove receiving the slide member, the sliding surface being provided inside said groove, preferably both the upper and lower edges of the groove being provided with respective sliding surfaces being in sliding contact with upper and lower parts of the slide member.

According to an embodiment the sliding surface is made from a material having a Vickers hardness of at least 50 MPa, more preferably at least 100 MPa, and most preferably at least 150 MPa, such as metal or glass, preferably the material is a metal.

The sliding surface may be made of aluminum and/or steel.

The sliding surface may be made of aluminum, e.g. a linear aluminum profile. According to one embodiment the aluminum has an anodized oxide surface layer onto which the lacquer is applied. Preferably the thickness of the anodized oxide surface layer is at least 5 micrometers, more preferably at least 10 micrometers.

The resin of the lacquer may comprise polar groups, such as hydroxyl groups, carboxylic acid groups, amide groups, cyano groups (nitrile groups), halide groups, sulfide groups, carbamate groups, aldehyde groups, and/or ketone groups.

In an embodiment, the resin of the lacquer is a thermosetting resin.

The resin of the lacquer may be selected from the group consisting of: acrylic resins, acrylate resins, acrylamide resins, methacrylate resins, methyl metachrylate resins, acrylonitrile resins, styrene-acrylonitril resins, acrylonitrile styrene acrylate resins, reaction products or a mechanical mixture of alkyd resin and water-soluble melamine resin, reaction products or a mechanical mixture of a vinyl-modified unsaturated alkyd resin and a water-soluble melamine resin, and polymers and mixtures of one or several of these resins.

The resin of the lacquer may be an acrylic resin, such as an acrylate resin, an acrylamide resin, a methacrylate resin, or a methyl metachrylate resin and mixtures thereof.

The thickness of the lacquer coated on the sliding surface may be 100 μm or less, preferably 75 μm or less, more preferably 5 to 75 μm, even more preferably 50 μm or less, still more preferably 10 to 50 μm, and yet more preferably 15 to 40 μm.

In an embodiment the sliding surface has been lacquered by electrocoating or autodeposition in a bath containing the lacquer, or by electrostatic coating with a powder lacquer; or by wet spraying the lacquer; preferably the sliding surface has been lacquered by electrocoating in a bath containing the lacquer or by electrostatic coating with a powder lacquer. These methods provide for even and thin layers of lacquers.

The sliding surface may be formed by an aluminum member, e.g. an aluminum profile, preferably an aluminum member having an anodized oxide surface layer, onto which the lacquer is applied, preferably the thickness of the anodized oxide surface layer is at least 5 micrometers, more preferably at least 10 micrometers, and wherein the surface layer, preferably an anodized oxide surface layer, has been electrophoretically, such as anaphoretically, coated with a resin, such as an acrylic resin, and subsequently heat cured to form the lacquer coated on the sliding surface, preferably the sliding surface has been coated using the Honny process or one of its derivatives.

The lipophilic composition coating comprises compounds comprising C6 to C40, such as C8 to C30, or even C10 to C24, non-aromatic hydrocarbyl groups, such as alkenyl groups and/or alkyl groups, e.g. alkyl groups.

The lipophilic composition coating present on the lacquer may comprise at least 25 wt. %, such as at least 50 wt. %, of compounds comprising C6 to C40, such as C8 to C30, alkyl groups.

In an embodiment the lipophilic composition coating present on the lacquer comprises at least 25 wt. %, such as at least 50 wt. %, C6 to C40, such as C8 to C30, non-aromatic hydrocarbons, such as alkenes and/or alkanes, e.g. alkanes.

The lipophilic composition coating present on the lacquer may comprise triglycerides and/or fatty acids; preferably said triglycerides, if present, comprises at least 75% saturated fatty acid residues and said fatty acids, if present, comprises at least 75% saturated fatty acids.

The lipophilic composition coating present on the lacquer may comprise 1 to 40 wt. % triglycerides and/or fatty acids, preferably said triglycerides, if present, being composed of fatty acids with C6 to C40, such as C8 to C30, alkyl groups, and preferably said fatty acids, if present, having C6 to C40, such as C8 to C30, alkyl groups.

The lipophilic composition coating present on the lacquer may comprise at least 25 wt. %, such as at least 50 wt. %, of triglycerides and/or fatty acids, preferably said triglycerides, if present, being composed of fatty acids with C6 to C40, such as C8 to C30, alkyl groups, and preferably said fatty acids, if present, having C6 to C40, such as C8 to C30, alkyl groups.

According to a second aspect, a drawer is provided comprising at least one drawer sliding system according to the first aspect described above.

One of said two parts may be a first guiding rail being connected to an associated cabinet, while the other of said at least two parts may be a second guiding rail being connected to the drawer, preferably at least one sliding surface being arranged on one of the first and second guiding rails, and at least one slide member being arranged on the other of the first and second guiding rails.

The drawer may comprise a first sliding system supporting one lateral side of the drawer, and a second sliding system supporting the opposite lateral side of the drawer.

BRIEF DESCRIPTION OF DRAWINGS

The invention will be described in further detail below under reference to the accompanying drawings, in which

FIG. 2*a* is an isometric view of a first part of a drawer sliding system according to an embodiment;

FIG. 2*b* is a cross-sectional view of the part shown in FIG. 2*a;*

FIG. 3*a* is an isometric view of a second part of the drawer sliding system according to the same embodiment;

FIG. 3*b* is a cross-sectional view of the part shown in FIG. 3*a;*

FIG. 4*a* is an isometric view of a third part of the drawer sliding system according to the same embodiment;

FIG. 4*b* is a cross-sectional view of the part shown in FIG. 4*a;*

DETAILED DESCRIPTION

Figure 1A:
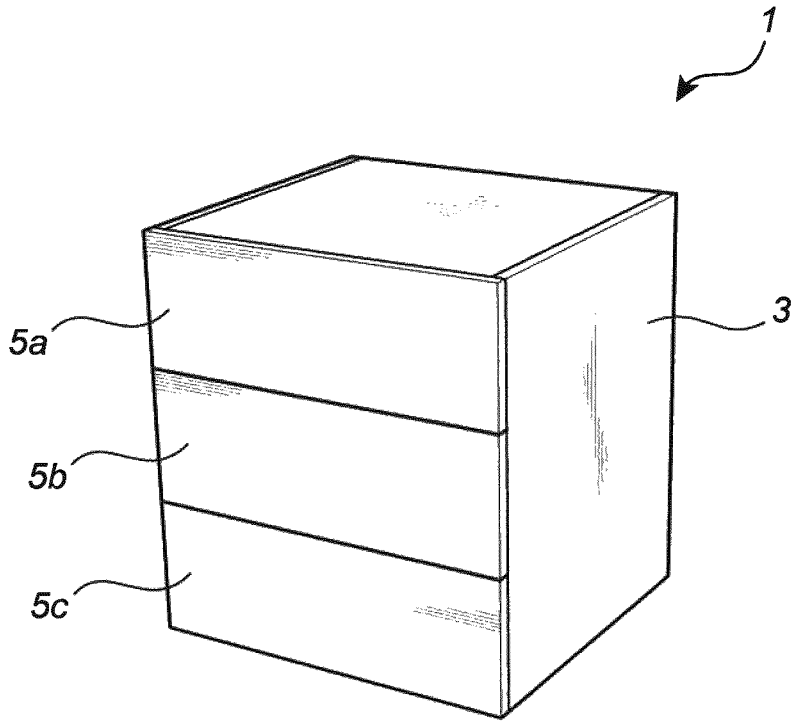
FIG. 1*a* is an isometric view of a chest of drawers.
Figure 1B:
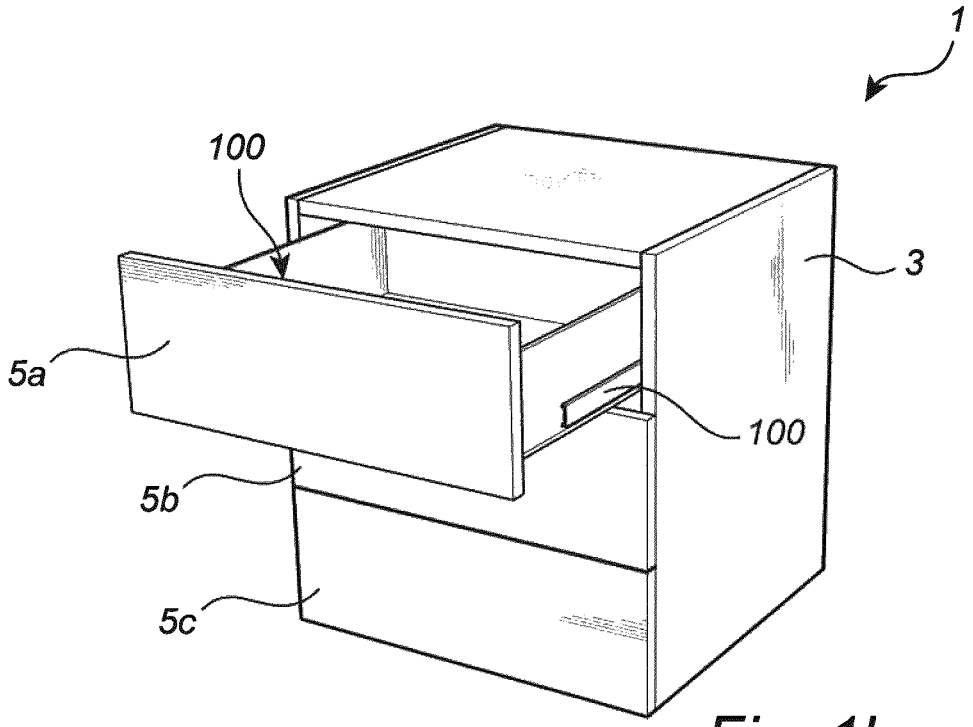
FIG. 1*b* is an isometric view of the chest of drawers shown in FIG. 1*a*, here shown in a state where the top drawer has been drawn out horizontally from the cabinet.

A chest of drawers 1 is schematically shown in FIGS. 1*a-b*. The chest of drawers 1 includes a cabinet 3, forming a fixed frame, and three drawers 5*a-c* which are moveably supported in the cabinet 3 such that each drawer 5*a-c* may be drawn out from the cabinet 3 in a horizontal direction.

In FIG. 1*a* the chest of drawers 1 is shown in a closed state, i.e. in a position in which each drawer 5*a-c* is maintained in its innermost position. In FIG. 1*b* the functionality of the chest of drawers 1 is shown, whereby the uppermost drawer 5*a* has been drawn out from its closed position in a horizontal direction. The movement of each drawer 5*a-c* is enabled by the provision of a drawer sliding system 100. In this embodiment each drawer 5*a-c* is provided with one drawer sliding system 100 at each side of the drawer, to connect the drawer to both sides of the cabinet 3, however one of the drawer sliding systems 100 of the drawer 5*a* is hidden in FIG. 1*b*.

For the embodiment of the chest of drawers 1 shown in FIGS. 1*a-b* each drawer sliding system 100 comprises a first part fixedly attached to the inside wall of the cabinet 3, a second part fixedly attached to the outer wall of the drawer 5*a-c*, and means allowing for a relative sliding movement between said first and second part. In an alternative embodiment a drawer may be provided with a drawer sliding system 100 at only one of its sides, or two drawer sliding systems arranged above each other on one of the sides of the drawer. The latter may be useful in drawers that are higher than they are wide. Furthermore, it is also possible to arrange one or more drawer sliding system under the drawer, for example in situations when it is desired that the drawer sliding systems are not to be visible. Combinations of the above mentioned locations of the drawer sliding systems are also possible.

Figure 5A:
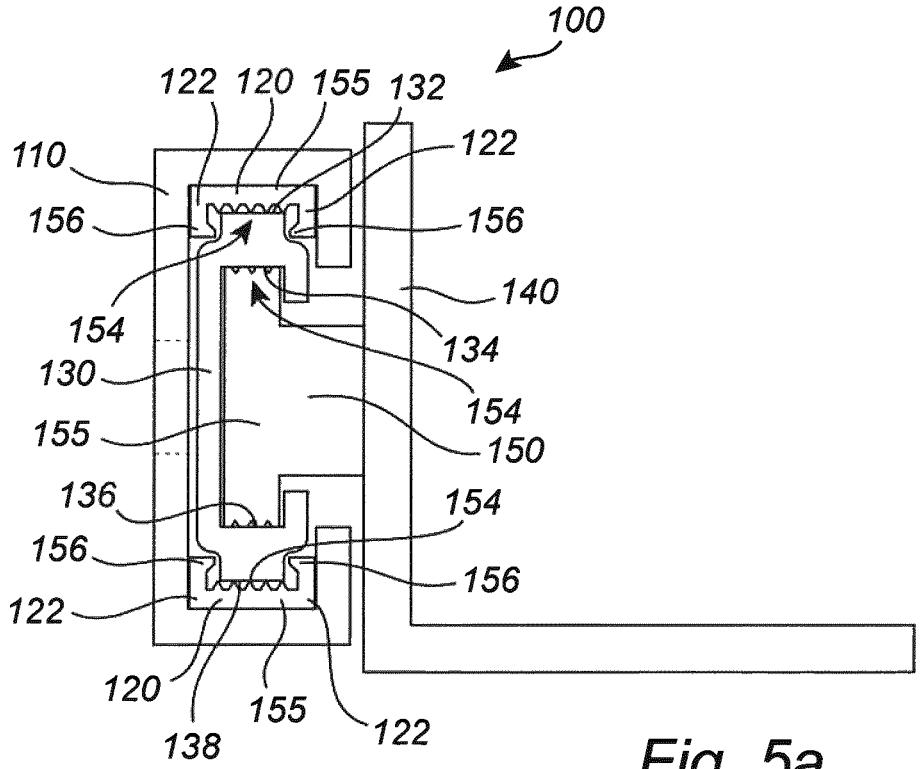
FIG. 5*a* is a cross-sectional view of the drawer sliding system shown in an assembled state.

An embodiment of a drawer sliding system 100 for a drawer 5*a-c* is shown in FIG. 5*a*, whereby the individual parts are further shown in FIGS. 2*a-b*, 3*a-b*, and 4*a-b*. The drawer sliding system 100 allows for a full extension of an associated drawer, meaning that the drawer may be drawn out from the cabinet until the rear end of the drawer is aligned with the front end of the associated cabinet.

The drawer sliding system 100 comprises a first guiding rail 110, which is best shown in FIGS. 2*a*-2*b*, comprising securing means 112, here in the form of two spaced apart through holes, for securely attaching the first guiding rail 110 to the inner wall of a cabinet, such as to the cabinet 3 illustrated in FIGS. 1*a*-1*b*. These securing means 112 thus forms a fastening arrangement for connecting the first guiding rail 110, including the sliding surfaces of the intermediate guiding rail (see below), to the inner wall of the cabinet. Horizontal mounting of the first guiding rail 110 is preferred. The first guiding rail 110 has a C-shape, better shown in FIG. 2*b*, and is provided with two or more sets of sliding members 120 that are all mounted inside the C-shape of the guiding rail 110. Two sliding members 120 are fixedly mounted to the upper part of the C-shape, and two sliding members 120 are fixedly mounted to the bottom part of the C-shape. The sliding members 120 are arranged in pairs, such that an upper sliding member 120 and a lower sliding member 120 are aligned in a vertical direction. The sliding members 120 are thus stationary relative the cabinet 3 when the first guiding rail 110 is mounted to the cabinet.

Now turning to FIGS. 3*a-b* the drawer sliding system 100 also comprises an intermediate guiding rail in the form of an intermediate slide bar 130. The intermediate slide bar 130 is configured as a C-shape and has an upper and outer sliding surface 132, an upper and inner sliding surface 134, a bottom and inner sliding surface 136, and a bottom and outer sliding surface 138, as best shown in FIG. 3*b*. These sliding surfaces 132, 134, 136, 138 are preferably planar, and the width of the outer sliding surfaces 132, 138 is dimensioned to engage with the sliding members 120 of the first guiding rail 110.

The intermediate slide bar 130 is thus configured to be received by the C-shaped first guiding rail 110.

The sliding system 100 also comprises a second guiding rail 140 to be fixedly mounted to a drawer, such as the drawer 5*a* of FIG. 1*b*. The second guiding rail 140 is provided with means (not shown), such as screw holes or similar, for attaching the second guiding rail 140 to the drawer. As can be seen in FIGS. 4*a-b* the second guiding rail 140 is L-shaped, whereby the lower part 142 can be used for aligning with the bottom end of the drawer. Hence the drawer may rest on the lower part 142, while the side wall of the drawer is screwed to the vertical part 144 of the second guiding rail 140.

The second guiding rail 140 is provided with one or more sliding members 150 protruding outwards for engagement with the inner sliding surfaces 134, 136 of the intermediate slide bar 130. In this embodiment there are two separate sliding members 150 attached to the vertical part 144 of each second guide rail 140. The vertical height of the sliding members 150 thus correspond to the distance between the two inner sliding surfaces 134, 136 of the intermediate slide bar 130.

A cross-sectional view of the drawer sliding system 100, when mounted, is shown in FIG. 5*a*. Two sliding interfaces are provided, the first one being realized by the sliding engagement between the sliding members 120 of the first guiding rail 110 and the outer sliding surfaces 132, 138 of the intermediate slide bar 130. The second sliding interface is realized by the sliding engagement between the inner sliding surfaces 134, 136 of the intermediate slide bar 130 and the sliding members 150 of the second guiding rail 140.

Figure 5B:
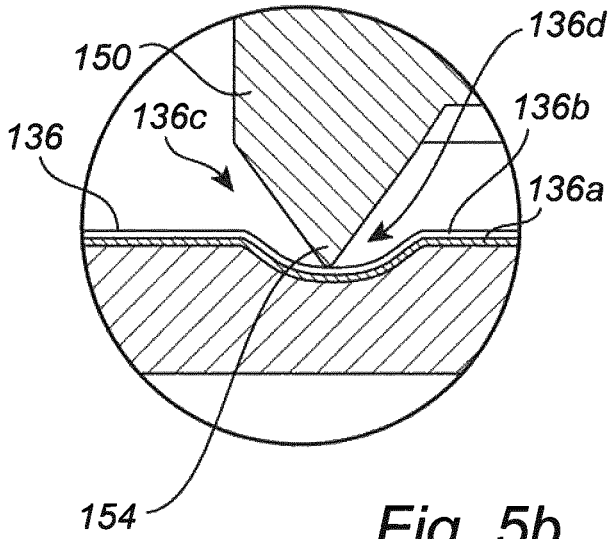
FIG. 5*b* is a cross-sectional view of the contact between a sliding member and a sliding surface according to an embodiment.

FIG. 5*b* is an enlarged principle view of the contact between a protrusion 154 of the sliding member 150 of the second guiding rail 140 and the sliding surface 136 of the intermediate slide bar 130. FIG. 5*b* illustrates how the sliding surface 136 is coated with the lacquer comprising a resin 136*a*. The lacquer comprising a resin 136*a* is in turn coated with a lipophilic composition coating 136*b*. Thereby a slide layer 136*c* is formed. The sliding member 150 may slide over this slide layer 136*c* at a very low friction. As can be seen in FIG. 5*b* the sliding surface 136 may be provided with a concave depression 136*d* for receiving the protrusion 154 of the sliding member 150. This may lead to an improved control of the lateral position of the sliding member 150 in relation to the intermediate slide bar 130. In accordance with alternative embodiments the sliding surface 136 may be substantially planar, without any depression. FIG. 5*b* also illustrates the relatively sharp tip of the protrusion 154, which may have the shape of a blade and which will be described in more detail hereinafter. In addition to the sliding members 150 being provided with one or more protrusions 154 also the sliding members 120 of the first guiding rail 110 may, as shown in FIG. 5*a*, be provided with protrusions 154 working according to similar principle as described in FIG. 5*b*.

Figure 6A:
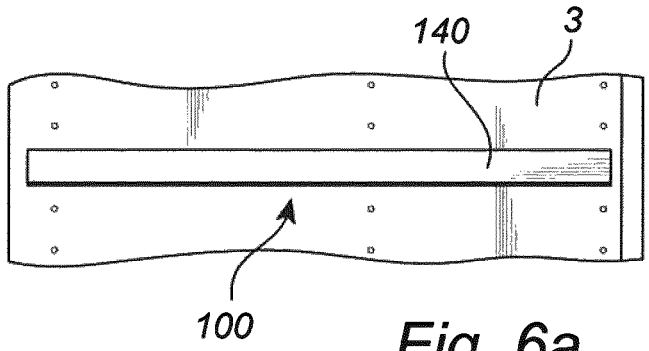
FIG. 6*a* is a side view of the drawer sliding system shown in an inserted state.
Figure 6B:
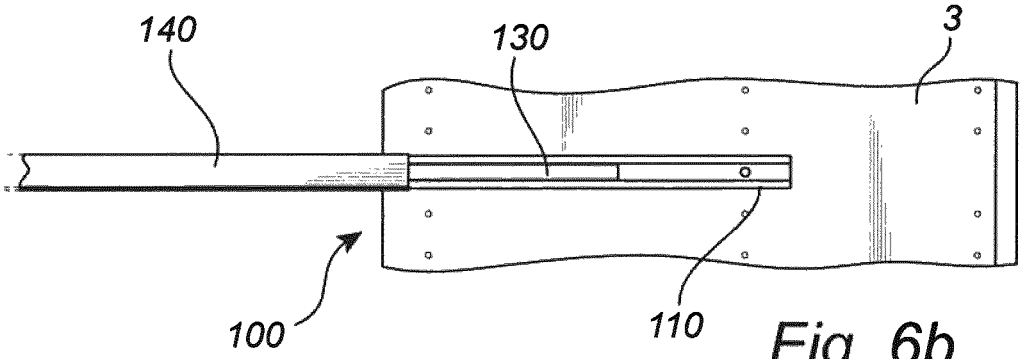
FIG. 6*b* is a side view of the drawer sliding system shown in a fully drawn-out state.

Operation of the drawer sliding system 100 is shown in FIG. 6*a-b*. The first guiding rail 110 is securely attached to the inner wall of a cabinet 3, for example by being screwed to the inner wall of the cabinet 3, and the drawer sliding system 100 is positioned in a compacted state (see FIG. 6*a*). In this position the intermediate slide bar 130 is fully received in the first guiding rail 110, and the second guiding rail 140, to which the drawer is securely attached, is positioned such that it covers the first guiding rail 110; as can be seen by comparing FIGS. 6*a* and 6*b*, the inner end of the second guiding rail 140 is arranged beyond the inner end of the first guiding rail 110. An imaginary drawer (not illustrated in FIGS. 6*a*-6*b* for reasons of maintaining clarity of illustration) is in this position arranged in its closed, or innermost, position.

In FIG. 6*b* an extended state of the drawer sliding system 100 is shown, in which the intermediate slide bar 130 has been drawn out relative the fixed first guiding rail 110. Further the second guiding rail 140 has been drawn out relative the intermediate slide bar 130. The imaginary drawer is in this position fully drawn out, meaning that the entire compartment of the drawer is accessible outside the cabinet 3. Any small overlap between the rear end of the second guiding rail 140 and the cabinet 3 merely corresponds to the thickness of the rear end of the drawer.

In order to provide the intermediate slide bar 130 with its respective sliding surfaces 132, 134, 136, 138, they are lacquered with a lacquer comprising a resin. Further, the lacquer is at least partly coated with a lipophilic composition to lower the sliding resistance, i.e. the friction. It has surprisingly been found that coating a surface lacquered with a resin, for example an acrylic resin, with a lipophilic composition, such as for example sebum (natural or artificial), coconut oil, or liquid paraffin, provides a slide layer with extremely low friction (sliding resistance). The application of the lipophilic composition reduces the dynamic friction with as much as 75%. Further, and even more surprisingly, the effect is not temporarily, but seemingly permanent or at least long-lasting. The need to replenish the lubricant may hence be dispensed with.

In experiments employing aluminum profiles having been anaphoretically coated with an acrylic resin subsequently heat cured to form a lacquer (cf. the Honny process, initially disclosed in GB 1,126,855), wherein the lacquer of the aluminum profiles was coated with sebum, the friction remained nearly the same after more than 70,000 test cycles of a sliding door being reciprocated along the profile. So many cycles by far exceed the expected number of lifetime cycles. Further, washing the coated aluminum profile with water/detergent, ethanol, and/or iso-propanaol didn't affect the friction. Without being bond to any theory, it seems that the sebum coating provides an irreversibly bound lubricant coating on top of the lacquer comprising the acrylic resin. Further, the lacquer seems to be important in providing low friction.

According to an embodiment there is thus provided a slide bar 130 acting as a guiding member and having at least one slide, or sliding surface 132, 134, 136, 138 coated with a lacquer comprising a resin. The lacquer is in turn at least partly coated with a lipophilic composition coating to provide a slide layer with lowered friction. By coating the lacquer, the sliding friction is not just temporarily lowered, but long term low sliding friction is obtained. As already explained the lubricating coating may be permanent, dispensing with the need to replenish the lubricating coating. Further, very low amounts of the lipophilic composition are needed to provide lowered friction. Thus, contamination of the lubricating coating does not pose any pronounced problem, as the coating, due to the very low amount present, does not have substantial adhesive properties. This is in contrast to the normal use of lubricants in plain bearings. Further, exposure to contaminations, e.g. dust etc., has been shown not to affect the lowered friction. Neither is the lubricating coating sensitive to washing. Wiping the sliding surfaces 132, 134, 136, 138 with a dry and/or wet cloth, does not affect the lowered friction.

Such a low amount of the lipophilic composition coating is needed, that the lipophilic composition may be applied to a sliding member 120, 150 rather than to the sliding surfaces 132, 134, 136, 138. In sliding over the sliding surfaces 132, 134, 136, 138, the lipophilic composition will be transferred to the sliding surface to provide a lipophilic composition coating. Hence, the lipophilic composition coating could be applied to the sliding surface 132, 134, 136, 138, to the sliding member 120, 150, or both.

According to an alternative embodiment a slide member is a sliding part whose slide layer, having a similar composition as the slide layer described hereinbefore, is arranged to slide along the longitudinal axis of a linear slide profile, e.g. a plastic profile, to form a linear plain bearing. At least the sliding surface of the sliding part may, according to one embodiment, be an aluminum surface, preferably having an anodized oxide surface layer, onto which the lacquer is applied. The thickness of the anodized oxide surface layer is preferably at least 5 micrometers, more preferably at least 10 micrometers. Further, the thickness of the anodized layer may be less than 250 micrometers, such as less than 100 micrometers or less than 50 micrometers.

While the sliding surface 132, 134, 136, 138 preferably is formed on an aluminum profile, preferably with an aluminum oxide layer, also other materials coated with a lacquer comprising a resin may be considered. In order to allow for long term use and to carry loads, the sliding surface 132, 134, 136, 138 is typically made from a hard material, such as metal or glass. Especially the surface of the slide member should preferably be hard. The Vickers hardness of the material from which the sliding surface 132, 134, 136, 138 is made, may be at least 50 MPa, more preferably at least 100 MPa, still more preferably at least 150 MPa, and most preferably at least 300 MPa. According to an embodiment, the sliding surface 132, 134, 136, 138 is formed on a metal bar, such as an aluminum bar or a steel bar. While it is preferred if an aluminum member has an oxide layer, also a raw, i.e. not oxidized, lacquered aluminum member may be used. It is however preferred if the surface of the aluminum member is oxidized to provide the aluminum member with a hard oxide surface layer.

The sliding surface 132, 134, 136, 138 may be formed on an aluminum bar or member. Further, the surface of the aluminum bar or member coated with the lacquer may be an aluminum oxide layer. The thickness of such oxide layer may be at least 5 micrometers, more preferably at least 10 micrometers. Further, the thickness of the oxide layer may be less than 250 micrometers, such as less than 100 micrometers or less than 50 micrometers. As known in the art, the durability and hardness of the surface of aluminum profiles may be improved by oxidation due to the properties of aluminum oxide. The oxide layer initially provided by anodically oxidation is porous. While the pores may be closed by steam treatment, sealing via anaphoretically coating with an acrylic resin subsequently heat cured to form the lacquer, is even more effective in sealing the porous aluminum oxide layer: This method, firstly disclosed by Honny Chemicals Co. Ltd. (cf. GB 1,126,855), is often referred to as the Honny process.

Further, compared to plastic sliding surface, a hard, stiff bar, such as aluminum or steel bar, may accept far more heavy loads and still provide low friction.

In addition, it has been found that a relatively high contact pressure in the contact between the sliding surface 132, 134, 136, 138 and the sliding member 120, 150 reduces the friction. For this reason as well it is beneficial to make the sliding surface 132, 134, 136, 138 from a hard material, such as aluminum or steel, since such materials can accept higher contact pressures, thereby reducing friction. The low friction also at high contact pressure is an advantageous property for a drawer with parallel sliding members, because prior art assemblies with two parallel members slidingly movable relative to two other parallel members often get stuck even if only slightly tilted.

According to an embodiment, the low friction sliding surface 132, 134, 136, 138 is formed on a linear, preferably oxidized (e.g. anodized), aluminum profile. The profile is typically anaphoretically coated with an acrylic resin subsequently heat cured, thereby providing a linear sliding surface 132, 134, 136, 138 having a lacquered slide surface. The aluminum profile may be anodized to obtain an anodized layer thickness of at least 5 micrometers, more preferably at least 10 micrometers, prior to application of the resin of the lacquer. Further, the thickness of the anodized layer may be less than 250 micrometers, such as less than 100 micrometers or less than 50 micrometers. Such profiles may be obtained via the Honny process (cf. above) or one of its derivatives. Typically, the Honny process is used to provide white, glossy profiles. However, neither the Honny process nor the present embodiments are limited to white profiles. The preferable feature is that the lacquer is suitable for being coated with the lipophilic composition coating.

As known in the art, various resins, e.g. thermosetting resins, may be used to lacquer aluminum bars and other bars, i.e. to form a lacquer on aluminum bars and other bars. Further, thermosetting resins may also be used to lacquer other metal members, e.g. a sliding member made of steel. The lacquer comprises a resin. As known to the skilled person, a lacquer is a hard, thin coating. The resin of the lacquer may for this application preferably comprise polar groups, such as hydroxyl groups, carboxylic acid groups, amide groups, cyano groups (nitrile groups), halide groups, sulfide groups, carbamate group, aldehyd groups, and/or ketone groups. Further may the resin of the lacquer be a thermosetting resin.

Examples of resins for lacquering metal comprise acrylic resins and polyurethane resins. According to an embodiment, the resin is an acrylic resin, such as an acrylate resin, an acrylamide resin, a methacrylate resin, or a methyl metachrylate resin, and mixtures thereof. According to another embodiment, the resin is a polyurethane resin. The acrylic resin may be a thermosetting resin.

According to another embodiment, the resin of the lacquer is selected from the group consisting of: acrylic resins, acrylate resins, acrylamide resins, methacrylate resins, methyl metachrylate resins, acrylonitrile resins, styrene-acrylonitril resins, acrylonitrile styrene acrylate resins, reaction products or a mechanical mixture of alkyd resin and water-soluble melamine resin, reaction products or a mechanical mixture of a vinyl-modified unsaturated alkyd resin and a water-soluble melamine resin, and polymers and mixtures of one or several of these resins.

Further, the thermosetting resin may the reaction product or a mechanical mixture of an alkyd resin and water-soluble melamine resin, or of a vinyl-modified unsaturated alkyd resin and a water-soluble melamine resin, the water-soluble melamine resin being obtained from hexamethylol melamine hexaalkylether. Vinyl modified unsaturated alkyd resins may be made by polymerization of a vinyl monomer with an alkyd resin composed of an unsaturated oil or fatty acid. As known to the skilled person, the term "vinyl monomer" relates to a monomer having a vinyl group (—CH═CH2) in the molecule, such as an acrylic ester, for example methyl acrylate and ethyl acrylate, a methacrylic ester, for example methyl methacrylate and hydroxyethyl methacrylate, an unsaturated, organic acid, for example acrylic acid and methacrylic acid, and styrene.

Processes for obtaining thermosetting acrylic resins are well-known to the skilled person. As an example, they may be obtained by heating and stirring a mixture consisting of organic solvents, such as methanol, ethylene glycol, monobutyl ether, and/or cyclohexanone, unsaturated organic acids, such as acrylic acid, methacrylic acid, and/or maleic anhydride, a cross-linking vinyl monomer (as defined above), such as methylol-acrylamide and/or methylol methacrylamide, a polymerizable vinyl monomer, such as styrene and/or acrylic acid ester, polymerization catalysts, such as benzoyl peroxides and/or lauroyl peroxides, and polymerization regulators, such as dodecyl mercaptan and/or carbon tetrachloride, to carry out polymerization, thereafter neutralizing the product with, for example, an aqueous solution of ammonia and/or triethylamine to make the resin soluble in water. Further, as known to the skilled person, thermosetting resins composed of alkyd resins and water-soluble melamine resin may be obtained from hexamethylol melamine hexaalkyl ether, may be obtained by mixing a water-soluble melamine resin at a temperature of from room temperature to 100° C. with an alkyd resin modified with a fatty acid, the alkyd resin having an acid value of from 10 to 80, and being obtained by heating a mixture consisting of (1) a saturated or unsaturated aliphatic acid, (2) ethylene glycol, glycerol, polyethylene glycol, other polyhydric alcohol or an epoxide, (3) adipic acid, sebacic acid, maleic anhydride or other polybasic acid or anhydride, and (4) a small quantity of cyclohexanone, toluene or other organic solvent. Thermosetting resins may also be obtained by mixing a water-soluble melamine resin and an alkyd resin from the ester exchange process, the resin being obtained by esterifying a mixture of dehydrated castor oil, an above-mentioned polyhydric alcohol and a small amount of an ester exchanging catalyst such as caustic potash, and thereafter esterifying also an above-mentioned polybasic acid or anhydride. As further known to the skilled person, thermosetting resins consisting of a modified acrylic resin and a water-soluble melamine resin, obtained from hexamethylol melamine hexaalkyl ether, may be obtained by polymerising by heating and stirring a mixture consisting of organic solvents, such as methanol, ethylene glycol, monobutyl ether and/or cyclohexanone, unsaturated acids, such as acrylic acid and/or methacrylic acid, a vinyl monomer (as hereinabove defined), such as styrene and/or acrylic acid ester, a cross-linking vinyl monomer, if necessary, such as methylol, is normally used. Good results may be obtained by using a concentration of resin of from 5 to 20% by weight and by regulating the voltage and the initial current density within a safe and economical range.

As known to the skilled person further resins for use in lacquering metal surfaces are known in the art. As an example, the resin of the lacquer may be selected from the group consisting of cationic epoxy electrocoat, epoxy and polyester resins, and polyester resins. Still further, lacquers adapted for autodeposition coating, such as Autophoretic™ coatings (e.g. Aquence™ Autophoretic® 866™ and BONDERITE® M-PP930™, the latter being an epoxy-acrylic urethane) available from Henkel AG, DE, may also be used in lacquering surfaces comprising iron.

The slide surface 132, 134, 136, 138 may be lacquered by electrocoating involving dipping a metal bar into a bath containing the lacquer and applying an electric field to deposit lacquer onto the metal bar acting as one of the electrodes. Further, the lacquer may be provided in powder form or in liquid form. Both powder and liquid lacquers may be sprayed onto the slide surface 132, 134, 136, 138 to coat it. For powder lacquers, electro static coating may be used.

Further, liquid lacquers in a bath may apart from electrocoating be applied by autodeposition.

In order to provide low friction, the thickness of the lacquer should be as even as possible. Thus it may be preferred to apply the lacquer by an electrocoating process, e.g. anaphoretic coating (cf. the Honny method) or cataphoretic coating, providing very even coatings. There are two types of electrocoating, i.e. anodic and cathodic electrocoating. Whereas the anodic process was the first to be developed commercially, the cathodic process is nowadays more widely used. In the anodic process, a negatively charged material is deposited on the positively charged component constituting the anode. In the cathodic process, positively charged material is deposited on the negatively charged component constituting the cathode. In the art, cathodic electrocoating is also known as cathodic dip painting (CDP), cathodic dip coating, cataphoretic coating, cataphoresis and cathodic electrodeposition. Further, the electrocoating process may also be referred to by the trade names of the bath material used. Examples include Cathoguard (BASF), CorMax (Du Pont), Powercron (PPG) and Freiotherm (PPG). Further, also electrostatically coating by powder lacquers or autodeposition in a bath provide even coatings and may thus be used.

In lacquering steel surfaces, autodeposition may be used. As recognized by the skilled person, one of the important steps in autodeposition is the coating bath itself, where water-based paint emulsion at low solids (usually around 4-8% by weight) is combined with two other products. A "starter" solution of acidified ferric (Fe3+) fluoride initiates the coating reaction and an oxidizing product stabilizes the metal ions in the solution. The coating emulsion is stable in the presence of ferric ions, but unstable in the presence of ferrous ions (Fe2+). Therefore, if ferrous ions are liberated from the metal substrate, localized paint deposition will occur on the surface Immersion of a component made from ferrous metal (e.g. steel) into an autodeposition bath causes the acidic environment to liberate ferrous ions, thereby causing the coating emulsion to be deposited, forming a mono-layer of paint particles. Henkel Adhesive Technologies (US)/Henkel AG & Co. KGaA (Germany) provides coatings under the trademark BONDERITE® for use in autodeposition.

As the lacquer coated on the sliding surface 132, 134, 136, 138 typically is more compressible than the material of the sliding surface 132, 134, 136, 138 itself, and as load carrying sliding member will apply pressure on the lacquer in sliding over the sliding surface 132, 134, 136, 138, the thickness of the lacquer preferably is to be kept thin to reduce compression of it. Compressing the lacquer may negatively affect the sliding resistance; especially at the start of the sliding sequence, i.e. when the sliding member starts to move along the sliding surface 132, 134, 136, 138 from a previous state of being at rest. According to an embodiment, the thickness of the lacquer coated on the sliding surface 132, 134, 136, 138 is thus 100 μm or less, preferably 75 μm or less, more preferably 50 μm or less. Further, the thickness of the lacquer coated on the sliding surface 132, 134, 136, 138 may be 5 to 75 μm, such as 10 to 50 μm, or 15 to 40 μm. Layers of these thicknesses have been found to provide for efficient sliding behavior, also at the instance when the sliding member starts to move along the sliding surface 132, 134, 136, 138.

Not only the low dynamic friction provided by the present slide member, but also the low difference between the static and dynamic friction provided by the present slide member is beneficial in terms of the sliding behavior.

In order to reduce the friction of the sliding surface 132, 134, 136, 138, the sliding surface 132, 134, 136, 138 is, at least partly, coated with a lipophilic composition coating to provide a slide layer. Further, while various components may be present in the lipophilic composition coating present on the lacquer, the composition typically comprises components with intermediate to long carbon chains, e.g. carbon chains having a carbon atom length of C6 or more, such as C8 or more. Thus, the lipophilic composition coating may comprise compounds comprising C6 to C40, such as C8 to C30 or even C10 to C24, non-aromatic hydrocarbyl groups. Typical examples of such non-aromatic hydrocarbyl groups are alkenyl groups and alkyl groups, e.g. alkyl groups. Examples of compounds comprising such non-aromatic hydrocarbyl groups are:

- C6 to C40 non-aromatic hydrocarbons, such as alkenes and/or alkanes, e.g. alkanes;
- tri-glycerides, e.g. triglycerides comprising C6 to C40, such as C8 to C30, non-aromatic hydrocarbyl groups; and
- fatty acids, e.g. C6 to C40, such as C8 to C30, carboxylic acids, and esters thereof, such as alkyl esters of fatty acids, e.g. methyl esters.

As known to the skilled person and as recognized in IUPAC's gold book (International Union of Pure and Applied Chemistry, Compendium of Chemical Terminology—Gold Book, Version 2.3.3 of 2014 Feb. 24):

- hydrocarbon denotes compounds consisting of carbon and hydrogen only;
- hydrocarbyl denotes univalent groups formed by removing a hydrogen atom from a hydrocarbon;
- alkane denotes acyclic branched or unbranched hydrocarbons having the general formula CnH2n+2;
- alkene denotes acyclic branched or unbranched hydrocarbons having one or more carbon-carbon double bond(s);
- alkyl denotes a univalent group derived from alkanes by removal of a hydrogen atom from any carbon atom —CnH2n+1;
- alkenyl denotes an univalent group derived from alkenes by removal of a hydrogen atom from any carbon atom;
- fatty acid denotes an aliphatic monocarboxylic acid;
- triglyceride denotes an ester of glycerol (propane-1,2,3-triol) with three fatty acids (tri-O-acylglycerol); and
- non-aromatic denotes a compound not comprising any cyclically conjugated molecular entity with increased stability due to delocalization.

According to an embodiment, the lipophilic composition coating present on the lacquer comprises at least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % of compounds comprising C6 to C40, such as C8 to C30, alkyl groups. Thus, the lipophilic composition coating may comprise least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % C6 to C40, such as C8 to C30, alkenes and/or alkanes, e.g. alkanes. Further, the lipophilic composition coating present on the lacquer may comprise least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % triglycerides and/or fatty acids (or alkyl esters thereof).

Whereas fatty acids have been found to improve the lubricating effect of mixtures of alkanes, such as liquid paraffin, they are less effective if used on their own. It is thus preferred if the lipophilic composition present on the lacquer is not only composed of fatty acids. The lipophilic composition present on the lacquer may thus comprise less than 99 wt. % fatty acids, such as less than 95 wt. % fatty acids. However, lipophilic compositions essentially only comprising triglycerides, such as coco nut oil, provide very low friction and do thus represent a preferred lipophilic composition present on the lacquer.

According to an embodiment, the lipophilic composition coating present on the lacquer comprises at least 1 wt. % such as at least 5 wt. %, 10 wt. %, 25 wt. %, 50 wt. %, 60 wt. %, 70 wt. %, 75 wt. %, 80 wt. %, 85 wt. % or at least 90 wt. % of alkenes and/or alkanes, e.g. alkanes and 0.1 to 50 wt. %, such as 1 to 40 wt. % or 5 to 30 wt. % triglycerides and/or fatty acids.

According to another embodiment, the lipophilic composition coating present on the lacquer comprises at least 1 wt. % such as at least 5 wt. %, 10 wt. %, 25 wt. %, 50 wt. %, 60 wt. %, 75 wt. %, 80 wt. % or at least 90 wt. % in total of triglycerides and/or fatty acids and 0.1 to 95 wt. %, such as 1 to 90 wt. % or 5 to 60 wt. % alkenes and/or alkanes, e.g. alkanes.

As already mentioned, typical examples of compounds comprising C8 to C40 non-aromatic hydrocarbyl groups are tri-glycerides and fatty acids. According to an embodiment, the lipophilic composition coating present on the lacquer comprises triglycerides and/or fatty acids. The lipophilic composition coating may thus comprise more than 25 wt. %, e.g. more than 50 wt. %, such as 50 to 100 wt. %, or 75 to 95 wt. %, in total of triglycerides and fatty acids. The triglycerides and/or fatty acids may either be used as the major component in the lipophilic composition coating or as additives.

If to be used as a major component, the lipophilic composition present on the lacquer coating may comprise more than 50 wt. %, such as 50 to 100 wt. %, or 75 to 95 wt. %, triglycerides, e.g. triglycerides to at least 90% wt composed of a glycerol residue and 3 residues of caproic acid, caprylic acid, capric acid, lauric acid, myristic acid, palmitic acid, stearic acid, and/or arachidic acid, such as 3 residues of lauric acids, myristic acid, palmitic acid, and/or stearic acid. According to an embodiment, the lipophilic composition coating present on the lacquer comprises coconut oil, such as at least 25 wt. % such as at least 50 wt. %, 60 wt. %, 70 wt. %, 75 wt. %, 80 wt. %, 85 wt. % or at least 90 wt. % coconut oil. Coconut oil comprises triglycerides composed of fatty acids that are to a high degree saturated fatty acids. The coconut oil may be hydrogenated to various degrees to further reduce the amount of unsaturated fatty acids residues. Further, the lipohilic composition coating present on the lacquer may comprise more than 50 wt. %, such as 50 to 100 wt. %, or 75 to 95 wt. % fatty acids, e.g. caproic acid, caprylic acid, capric acid, lauric acid, myristic acid, palmitic acid, stearic acid, and/or arachidic acid, such as lauric acids, myristic acid, palmitic acid, and/or stearic acid. Furthermore, the lipophilic composition coating present on the lacquer may comprise more than 50 wt. %, such as 50 to 100 wt. %, or 75 to 95 wt. % alkyl esters of fatty acids, e.g. methyl or ethyl esters. The esterfied fatty acids may be caproic acid, caprylic acid, capric acid, lauric acid, myristic acid, palmitic acid, stearic acid, and/or arachidic acid, such as myristic acid, palmitic acid, and/or stearic acid.

If to be used as an additive, the lipophilic composition coating present on the lacquer may comprise 0.1 to 50 wt. %, such as 1 to 30 wt. % or 5 to 15 wt. %, triglycerides, e.g. triglycerides to at least 90% composed of a glycerol residue and 3 residues of caproic acid, caprylic acid, capric acid, lauric acid, myristic acid, palmitic acid, stearic acid, and/or arachidic acid, such as 3 residues of lauric acids, myristic acid, palmitic acid, and/or stearic acid. A preferred example of composition to be used to provide a lipophilic composition coating comprising triglycerides is coconut oil. According to an embodiment, the lipohilic composition coating present on the lacquer comprises coconut oil, such as 0.1 to 50 wt. %, such as 1 to 30 wt. % or 5 to 15 wt. %, coconut oil. According to an embodiment, the lipophilic composition coating 141*b* present on the lacquer comprises at least 50 wt. % coconut oil, such as at least 60 wt. %, 70 wt. %, 75 wt. %, 80 wt. %, 85 wt. %, or at least 90 wt. % coconut oil. Coconut oil comprises triglycerides composed of fatty acids that are to a high degree saturated fatty acids. The coconut oil may be hydrogenated to various degrees to further reduce the amount of unsaturated fatty acids residues. Further, the lipohilic composition present on the lacquer may comprise 0.1 to 50 wt. %, such as 1 to 30 wt. % or 5 to 15 wt. %, of fatty acids, e.g. caproic acid, caprylic acid, capric acid, lauric acid, myristic acid, palmitic acid, stearic acid, and/or arachidic acid, such as lauric acid, myristic acid, palmitic acid, and/or stearic acid. Furthermore, the lipohilic composition coating present on the lacquer may comprise 0.1 to 50 wt. %, such as 1 to 30 wt. % or 5 to 15 wt. %, of alkyl esters of fatty acids, e.g. methyl or ethyl esters. The esterfied fatty acids may be caproic acid, caprylic acid, capric acid, lauric acid, myristic acid, palmitic acid, stearic acid, and/or arachidic acid, such as myristic acid, palmitic acid, and/or stearic acid.

Both saturated and un-saturated compounds comprising C6 to C40 non-aromatic hydrocarbyl groups are well-known in the art. While both types of compounds will be efficient in reducing the sliding resistance, saturated compounds comprising C6 to C40 non-aromatic hydrocarbyl groups are deemed to be less sensitive to oxidative degradation. Thus, it may be preferred to use compounds comprising C6 to C40 non-aromatic hydrocarbyl groups being triglycerides composed of saturated fatty acids residues and/or saturated fatty acids in the composition. It may however not be necessary to use a 100% saturated fatty acids and/or triglycerides. As example, coconut oil is envisaged to have sufficient long term stability, though saturated fatty acids and/or triglycerides are preferred in terms of their long term stability.

As mentioned, the lipophilic composition coating present on the lacquer may comprises at least 1 wt. % C6 to C40 alkanes. As an example, the lipophilic composition coating present on the lacquer may thus comprise mineral oil, such as at least 1 wt. %, such as at least 5 wt. %, 10 wt. %, 25 wt. %, 50 wt. %, 60 wt. %, 70 wt. %, 75 wt. %, 80 wt. %, 85 wt. % or at least 90 wt. % mineral oil. Mineral oil is a colorless, odorless, light mixture of higher alkanes from a non-vegetable (mineral) source. Further, the lipohilic composition present on the lacquer coating may comprise liquid paraffin, such as at least 1 wt. %, such as at least 5 wt. %, 10 wt. %, 25 wt. %, 50 wt. %, 60 wt. %, 70 wt. %, 75 wt. %, 80 wt. %, 85 wt. % or at least 90 wt. % liquid paraffin. Liquid paraffin, also known as paraffinum liquidum, is a very highly refined mineral oil used in cosmetics and for medical purposes. A preferred form is the one having CAS number 8012-95-1. Furthermore, the lipophilic composition coating present on the lacquer may comprise petroleum jelly (also known as petrolatum, white petrolatum, soft paraffin or multi-hydrocarbon), such as at least 1 wt. %, such as at least 5 wt. %, 10 wt. %, 25 wt. %, 50 wt. %, 60 wt. %, 70 wt. %, 75 wt. %, 80 wt. %, 85 wt. % or at least 90 wt. % petroleum jelly. Petroleum jelly is a semi-solid mixture of hydrocarbons (with carbon numbers mainly higher than 25). A preferred form is the one having CAS number 8009-03-8.

Each sliding surface 132, 134, 136, 138 is configured to be in sliding contact with at least one sliding member 120, 150 provided on the first or second guiding rail 110, 140, respectively. A low friction sliding surface 132, 134, 136, 138 of the intermediate slide bar 130 is thus allowed to engage with the respective sliding member 120, 150 such that movement of the intermediate slide bar 130 and the second guiding rail 140 relative the first guiding rail 110 is possible.

The respective sliding members 120, 150 can be attached to their respective carrier, i.e. the first or second guiding rail 110, 140, in a number of ways. Suitable attachments could, e.g., include adhesives, screws, dowels, snap-action attachments etc.

As has already been explained above the sliding system 100 comprises the disclosed sliding surface 132, 134, 136, 138 and at least one sliding member 120, 150. The sliding surface 132, 134, 136, 138 is typically linear, such as formed on a linear aluminum profile. By arranging the interface between the sliding surface 132, 134, 136, 138 and the sliding member 120, 150 in sliding contact a linear plain bearing is provided. The sliding member 120, 150 is arranged to allow for linear movement of the sliding member 120, 150 in sliding over the sliding surface 132, 134, 136, 138 along the longitudinal axis. Further, the sliding surface 132, 134, 136, 138 may be provided in the shape of a groove extending along a longitudinal axis and defining a slide direction. When the sliding surface 132, 134, 136, 138 is provided by means of a groove, the slide layer is present in the groove.

Further, the part of the sliding member 120, 150 arranged in contact with the sliding surface 132, 134, 136, 138 may be configured as a protrusion, for example having the form of a blade extending in the sliding direction. It was surprisingly found that decreasing the contact area at the interface between the sliding surface 132, 134, 136, 138 and the sliding member 120, 150 reduced the friction. Normally the risk for the bearing seizing typically increases with reduced contact area. In order to provide the sliding system, the sliding member 120, 150 comprises at least one contact point in contact with the sliding surface 132, 134, 136, 138 at the interface between the sliding surface 132, 134, 136, 138 and the sliding member 120, 150. According to an embodiment, the contact area of each individual contact point is less than 3 $mm^2$, such as less than 1.5 $mm^2$, or less than 0.75 $mm^2$. The slide member 150 may further be provided with more than one contact point, such as 2, 3, or 4 contact points. If the sliding member 120, 150 is configured as having a protrusion in the form of a blade extending in the sliding direction, its edge represents the contact point.

It has been found that the friction becomes lower when the contact pressure between the sliding member 120, 150 and the sliding surface 132, 134, 136, 138 is relatively high. The contact pressure is calculated by dividing the load carried by each individual contact point by the contact area of the contact point. An example, in which the sliding system was utilized for sliding doors, was used to calculate the contact pressure. If the sliding door has a total weight of 8.5 kg this represents a total load of 83.3 N. The sliding door may be carried by two sliding members where each sliding member having four contact points, each such contact point having an area of 0.675 $mm^2$. The contact pressure is then: 83.3 $N/(2\times4\times0.675\ mm^2)=15.4\ N/mm^2$. Preferably, the contact pressure in said at least one contact point is at least 4 $N/mm^2$, more preferably at least 8 $N/mm^2$, such as at least 12 $N/mm^2$. Preferably, the contact pressure is lower than the strain at yield (=yield strength) for the material from which the sliding member is made.

In order to provide low friction, at least the part of the sliding member 120, 150 in contact with the sliding surface 132, 134, 136, 138 is preferably made of a plastic comprising a polymer, such as a polymer comprising polar groups. Examples of such polar groups include hydroxyl groups, carboxylic acid groups, amide groups, halide groups, sulfide groups, cyano groups (nitrile groups), carbamate groups, aldehyde groups, and/or ketone groups.

The polymer may be selected from the group consisting of polyoxymethylenes (POM), polyesters (e.g. thermoplastic polyesters, such as polyethylene terephthalate (PET), polytrimethylene terephthalate (PTT), polybutylene terephthalate (PBT), and polylactic acid (PLA), as well as bio-based thermoplastic polyesters, such as polyhydroxyalkanoates (PHA), polyhydroxybutyrate (PHB), and polyethylene furanoate (PEF)), polyamides (PA), polyvinyl chloride (PVC), polyphenylene sulfide (PPS), polyaryletherketone (PAEK; e.g. Polyether ether ketone (PEEK)), and Polytetrafluoroethylene (PTFE). Further, not only the part of the sliding member 150 in contact with the sliding surface 132, 134, 136, 138 may be made of a polymer, but the entire sliding member 120, 150. Thus, sliding member may be made from a plastic comprising a polymer. As recognized by the skilled person, the plastic may further comprise other additives, such as fillers, colorants, and/or plasticizers. Further, the sliding member 120, 150 may be made from a composite comprising a polymer, such as one of the above listed polymers, optionally filled with particles and/or fibers. The particles and/or fibers will increase the hardness, the stiffness, the creep resistance and elongation (compression) at yield of the sliding member 120, 150. While not affecting the friction, presence of particles and/or fibers may affect the wear. Thus, use of particles and/or fibers in the plastic is less preferred.

According to an embodiment the sliding member 120, 150 may be provided with two parallel, displaced blades in order to reduce the risk for rotation along the sliding axis. Further, the sliding surface 132, 134, 136, 138 may be provided with two parallel depressions arranged along each side of its longitudinal sliding axis (see FIG. 5*b*). Parallel depressions may support and guide such two parallel blades of the sliding member 120, 150. Furthermore, the sliding member 120, 150 may be provided with two or more parallel blades arranged along the same longitudinal axis. The sliding member 120, 150 may be provided with two parallel blades adapted for running in the same depression independently of the presence, or non-presence, of parallel, displaced blades adapted for running in two parallel depressions.

Each sliding member 120, 150 has at least one, and preferably a plurality of relatively sharp protrusions 154, e.g. blades in accordance with the description above, extending out from a main body 155 of the respective sliding member 120, 150, as is illustrated in FIG. 5*a*. When mounted the main body 155 with its projections 154 protrude towards the respective sliding surface 132, 134, 136, 138 such that the protrusions 154 comes into sliding contact with the respective sliding surface 132, 134, 136, 138. This is especially shown in FIG. 5*a*.

Each of the sliding members 120 being shown in FIG. 5*a* and FIG. 2*b* has, in this embodiment, five protrusions 154 being in sliding contact with the respective sliding surface 132, 138 of the intermediate slide bar 130 (FIG. 5*a* and FIG. 3*b*). The sliding members 120 however also have vertical projections 122 extending along the C-shaped first guiding rail 110, and side supporting protrusions 156 are provided on each vertical projection 122. The side supporting protrusions 156 are directed horizontally inwards towards a vertical part of the respective sliding surface 132, 138. The side support protrusions 156 do not carry the load of the drawer, but keeps the drawer in its intended lateral position, and keeps the sliding surfaces 132, 138 correctly positioned in relation to the protrusions 154.

Each protrusion 154, 156 may extend along the entire length of the main body 155. According to an alternative embodiment one or more of the protrusions may be divided into several segments distributed along the length of the main body 155. The vertically extending protrusions 154 carry most of the load of the drawer and ensure the correct vertical position of the drawer relative to the first guiding rail 110, while the horizontally extending protrusions 156 provides alignment in the horizontal plane relative the first guiding rail 110.

Each protrusion 154, 156 may preferably have a pyramidal shape, i.e. the distal end of each protrusion 154, 156 forms an apex of a certain angle corresponding to the blade, or contact point, described above. Hence each protrusion 154, 156 will only form a very small contact surface with its associated sliding surface 132, 134, 136, 138. It should be understood that the exact configuration of the protrusions 154, 156 is to be determined based on specific application parameters, such as length and width of the associated sliding surface 132, 134, 136, 138, the desired force being required to pull and push the drawer 5*a-c*, the material of the sliding member 120, 150 and the sliding surface 132, 134, 136, 138, etc.

It should be noted that each of the sliding members 120, 150 has a certain length, whereby the protrusions, e.g., the blades 154, 156, have an axial extension. The length of the respective sliding member 120, 150 is preferably substantially shorter than the length of the first and second guiding rail 110, 140, respectively, to which the sliding member 120, 150 is connected. Although not limited to a specific value, good results have been shown using sliding members 120, 150 having a length, as seen in the sliding direction of the respective guiding rail 110, 140, of about 2-50 mm, more preferably a length of 5-30 mm. The length of the protrusions, e.g. the blades, 154, 156 could be in a similar range as the length of the sliding member, i.e. the protrusions 154, 156 could have a length of 2-50 mm, more preferably 5-30 mm. In case the protrusions 154, 156 are divided into segments along their length, each such segment could have a length of 2-10 mm, with a gap of 1-5 mm between consecutive segments. The manner of defining the length of the protrusions, e.g. the blades, is for example shown in FIG. 12*a*, the length of the protrusions 354*c* being denoted L1 therein.

Figure 7:
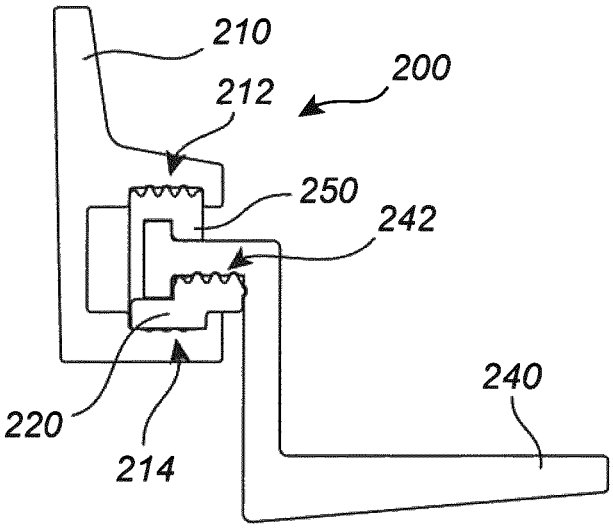
FIG. 7 is an end view of a drawer sliding system according to another embodiment.

Now turning to FIG. 7 another embodiment of a drawer sliding system 200 is shown in an end view. Being similar to the sliding system 100 previously described this embodiment as well relies on the novel configuration of a low-friction sliding surface engaging with a sliding member.

A first guiding rail 210 is configured to be fixedly mounted to the inner wall of a cabinet 3, and a second guiding rail 240 is configured to be fixedly mounted to a side wall of a drawer 5*a-c*. As there is no intermediate slide bar in this embodiment, the second guiding rail 240 is configured to be slidingly moveable relative the first guiding rail 210. For this purpose the first guiding rail 210 is provided with a sliding member 220 to engage with a sliding surface 242 of the second guiding rail 240, while the second guiding rail 240 is provided with a sliding member 250, partly hidden in the perspective of FIG. 7, to engage with sliding surfaces 212, 214 of the first guiding rail 210, as will be described in more detail hereinafter.

Figure 8A:
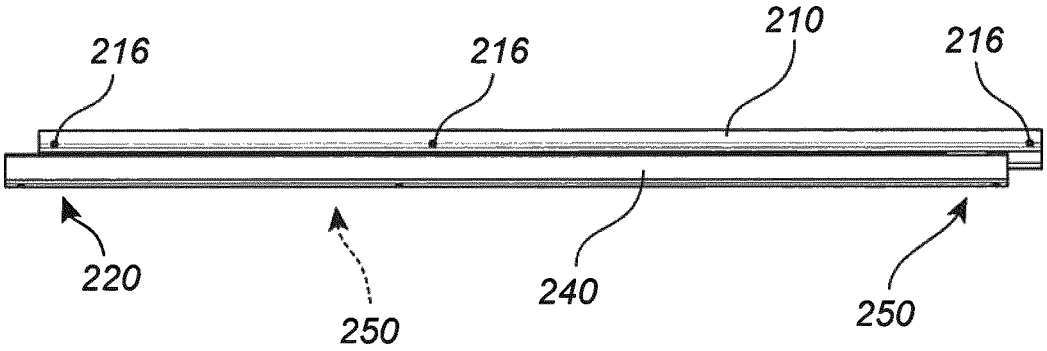
FIG. 8*a* is a side view of the drawer sliding system shown in FIG. 7.
Figure 8B:
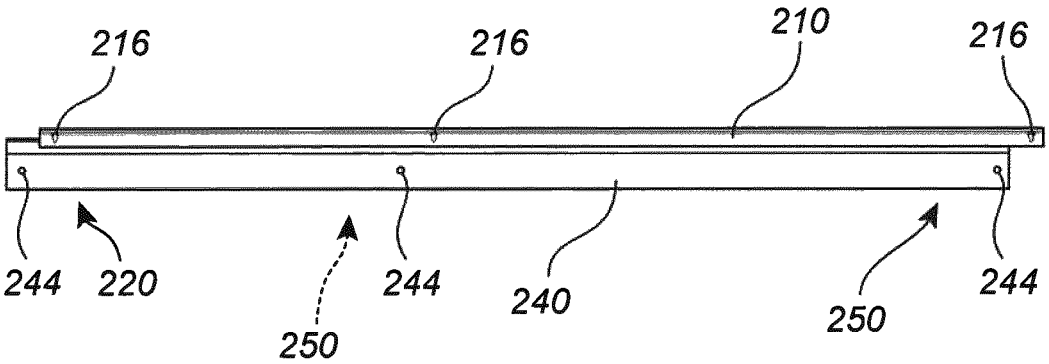
FIG. 8*b* is a top view of the drawer sliding system shown in FIG. 7.

In FIG. 8*a* the drawer sliding system 200 is shown in a side view and in a compacted state, i.e. the state that the drawer sliding system 200 has when the drawer 5*a-c* is in its innermost position inside the cabinet 3. The first guiding rail 210 has through holes 216 for screwing the guiding rail 210 to the inner wall of the cabinet 3. As is shown in FIG. 8*b*, which illustrates the drawer sliding system 200 in its compacted state but in a top view, the second guiding rail 240 also has through holes 244 for screwing the guiding rail 240 to the underside of the drawer 5*a-c*. The sliding member 220 being attached to the first guiding rail 210 is provided at the front end of the first guiding rail 210, while the sliding member 250 being attached to the second guiding rail 240 is provided at the rear end of the second guiding rail 240 (both sliding members 220, 250 are hidden in the perspective of FIGS. 8*a* and 8*b*, but the respective arrows indicate their positions). This means that the sliding members 220, 250 are arranged as long as possible from each other for maximizing the capability of the drawer sliding system 200 to carry the load of the drawer 5*a-c*. Further, as sliding member 220 is arranged at the outermost position of the first guiding rail 210 the weight of the drawer will be suspended in an efficient manner due to the fact that the second guiding rail 240, and hence the drawer itself, rests on the sliding member 220 which is duly attached to the first guiding rail 210. When the drawer 5*a-c* is pulled out of the cabinet 3 the second guiding rail 240 is moved to the left in the perspective of FIGS. 8*a* and 8*b*, and slides along the first guiding rail 210. With the drawer sliding system 200 of FIGS. 7, 8*a-b* it is not possible to obtain a complete pull out of the drawer, as is possible with the drawer sliding system 100 described in FIGS. 5*a* and 6*a-b*. Instead, the drawer sliding system 200 is used in applications where it is sufficient to pull out the drawer 5*a-c* to about three quarters of its total length. At such three quarter pull out of the drawer 5*a-c* the sliding member 250 of the second guide rail 240 would be located close to the central screw hole 216 of the first guiding rail 210. In FIGS. 8*a-b* this three quarter pulled out position of the sliding member 250 is indicated by a broken arrow. The chest of drawers 1 illustrated in FIG. 1*b* is shown with a three quarter pulled out drawer 5*a* which would be achievable using the drawer sliding system 200, although FIG. 1*b* illustrates another drawer sliding system 100.

Figure 9A:
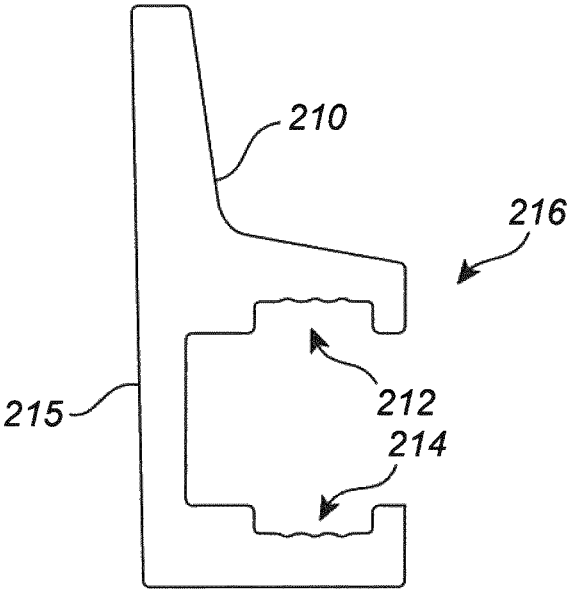
FIG. 9*a* is a front view of a first part of the drawer sliding system shown in FIG. 7.

Cross-sectional views of the parts of the sliding system 200 are shown in FIGS. 9*a-e*. In FIG. 9*a* the first guiding rail 210 is shown. The first guiding rail 210 has a vertical mounting surface 215 for ensuring a parallel mounting relative the cabinet's 3 wall. A C-shaped body 216 extends perpendicularly out from the mounting surface 215 in a direction towards the drawer 5*a-c* in use. The C-shaped body 216 is provided with the upper sliding surface 212 and the lower sliding surface 214, respectively. Both sliding surfaces 212, 214 face inwards, i.e. they are provided as inner surfaces of the C-shaped body 216. Optionally, the sliding surfaces 212, 214 may be provided with concave depressions that are similar to the type of concave depression 136*d* described hereinbefore with reference to FIG. 5*b*.

Figure 9B:
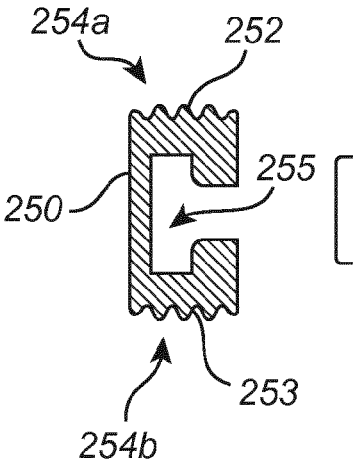
FIG. 9*b* is a front view of a second part of the drawer sliding system shown in FIG. 7.

In FIG. 9*b* the sliding member 250 is shown, which sliding member 250 is configured to engage with the sliding surfaces 212, 214 of the first guiding rail 210. The sliding member 250 is provided as a block or bar having an upper surface 252 with a plurality of protrusions 254*a*, being similar to the protrusions, blades, or points of contact described above. A lower surface 253 is also provided with similar protrusions 254*b*. The sliding member 250 is dimensioned such that the upper protrusions 254*a* engage with the sliding surface 212 of the first guiding rail 210, while the lower protrusions 254*b* engage with the sliding surface 214 of the first guiding rail 210. The sliding member 250 may also be provided with attachment means, such as adhesive, screw holes, snap-action fittings etc. (not shown) for holding the sliding member 250 in a fixed position on the second guiding rail 240.

The length of the sliding member 250 does not need to match the length of any of the guiding rails 210, 240; instead the length of the sliding member 250 may be significantly shorter, e.g. in the range of 2-50 mm for a drawer 5*a-c* having a depth of approximately 200-600 mm. Preferably the protrusions 254*a*, 254*b* extend along at least a part of the length of the sliding member 250.

The sliding member 250 is, as mentioned hereinabove, preferably fixedly attached to a rear end of the second guiding rail 240. The second guiding rail 240 is further shown in FIG. 9*c*, wherein a T-shaped member 244 of the second guide rail 240, facing the first guiding rail 210 in use, is dimensioned to fit within a recess 255 of the sliding member 250 such that the sliding member 250 may be securely positioned onto the T-shaped member 244. The T-shaped member 244 is connected to, and preferably integrally formed with, an L-shaped body 246 of the second guiding rail 240 for providing a rigid support structure when mounted to the side wall and/or bottom end of the drawer 5*a-c*.

Figure 9C:
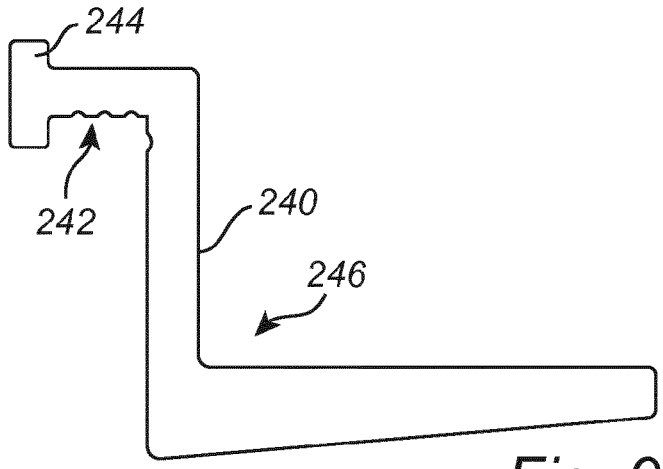
FIG. 9*c* is a front view of a third part of the drawer sliding system shown in FIG. 7.
Figure 9D:
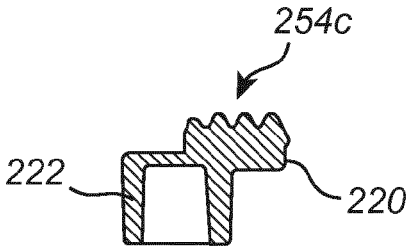
FIG. 9*d* is a cross-sectional view of a fourth part of the drawer sliding system shown in FIG. 7.
Figure 9E:
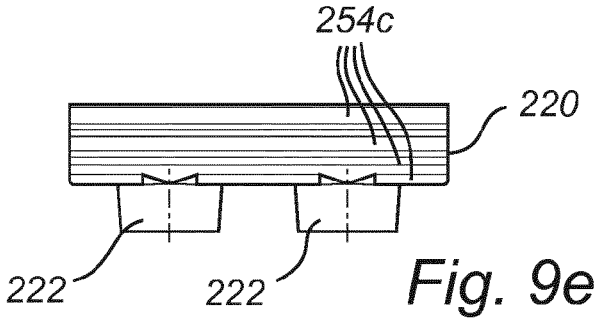
FIG. 9*e* is a side view of the fourth part shown in FIG. 9*d;*

The sliding surface 242 of the second guiding rail 240 is configured to engage, in a sliding manner, with the sliding member 220, shown in FIGS. 9*d-e*, which sliding member 220 is fixedly mounted to the front part of the first guiding rail 210. The sliding member 220 has upwardly directed protrusions 254*c*, being similar to the protrusions, blades, or points of contact described earlier. The length of the sliding member 220 is preferably similar to the length of the other sliding member 250 described hereinbefore. As is seen in FIGS. 9*d-e* fixation of the sliding member 220 may be accomplished by providing the sliding member 220 with downwards protruding plugs 222, which may be pressed into mating holes in the sliding surface 214 of the first guiding rail 210 (see FIG. 9*a*, although the mating holes are not shown here).

As can be seen in especially FIGS. 9*a* and 9*c* the sliding surfaces 212, 214, 242 may be provided with a small curvature forming small concave areas, wherein each concave area is dimensioned to receive a protrusion 254*a-c* of the associated sliding member 220, 250, in accordance with the principle described hereinbefore with reference to FIG. 5*b*.

Figure 10:
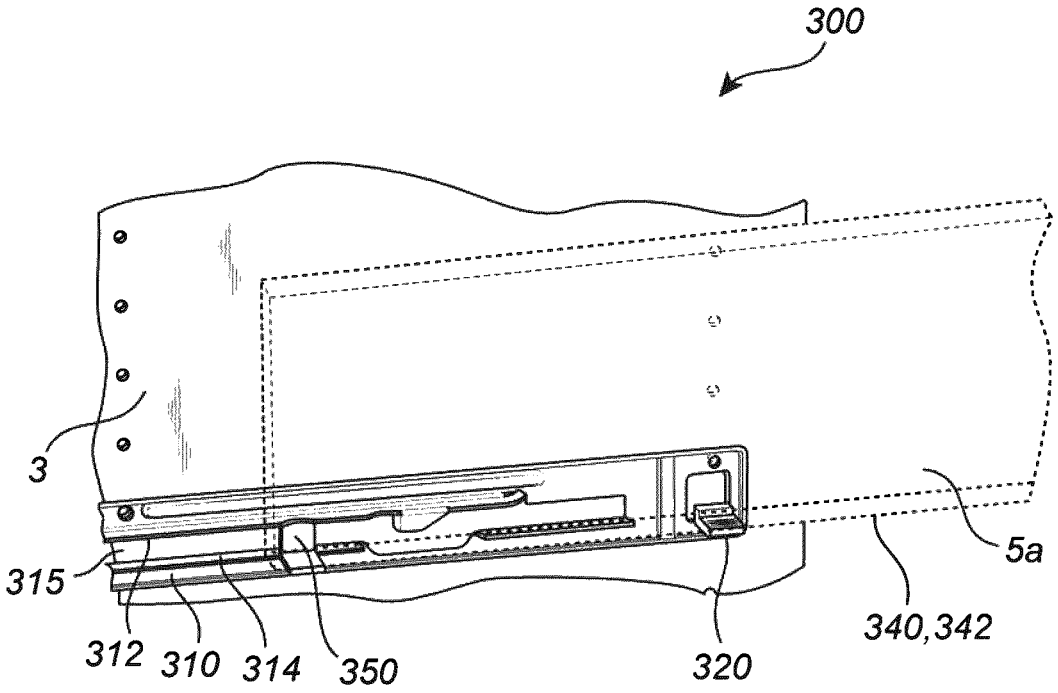
FIG. 10 is a side view of a drawer sliding system according to a yet further embodiment.
Figure 11A:
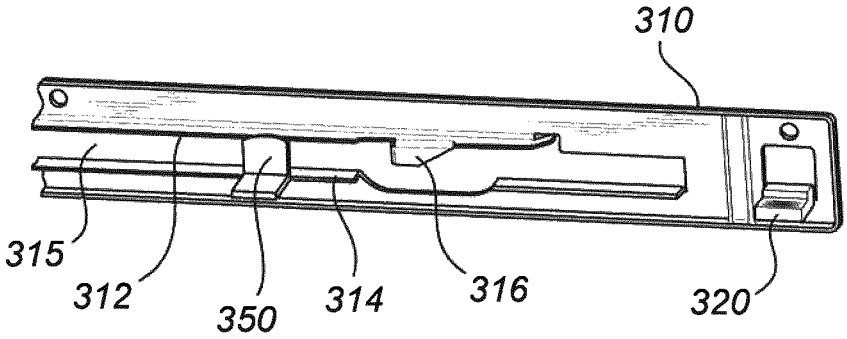
FIG. 11*a* is a side view of a first part of the drawer sliding system shown in FIG. 10.
Figure 11B:
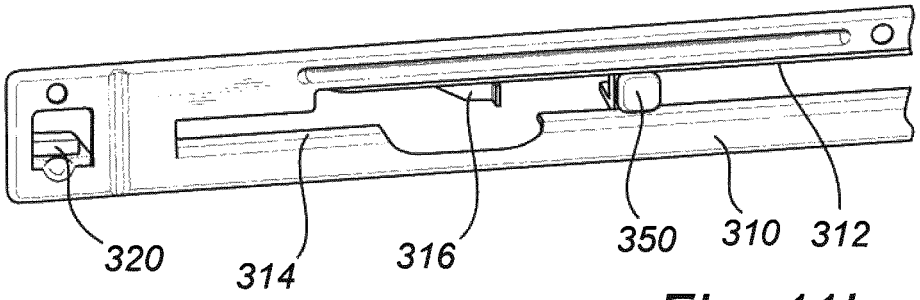
FIG. 11*b* is a side view, seen from the opposite side, of the first part of the drawer sliding system shown in FIG. 11*a;*

Now turning to FIG. 10 another embodiment of a drawer sliding system 300 is shown. The drawer sliding system 300 is similar to the sliding system 200 previously described in that a first guiding rail 310 is securely attached to the inner wall of the cabinet 3, while a second guiding rail 340 is fixed at the drawer 5*a*. However, as can be seen in FIG. 10 the second guiding rail 340 is a very simple construction, here formed by a sliding surface 342 being provided on the bottom end of the drawer 5*a*. The second guiding rail 340 may thus be a metal strip or bar being glued to the bottom of the drawer 5*a*, and having a sliding surface 342. The rear end of the second guiding rail 340 is provided with a sliding member 350 which extends inwards towards the first guiding rail 310. The first guiding rail 310 has, as is also shown in FIGS. 11*a-b*, a groove 315 extending along a part of its length, which groove is dimensioned to receive the sliding member 350. The upper and lower edges of the groove 315 are provided with a respective sliding surface 312, 314 as described previously for contacting, in a sliding manner, the sliding member 350.

The first guiding rail 310 is also provided with a sliding member 320 at its front end, creating a low friction guidance of the sliding surface 342 of the second guiding rail 340. Also, the sliding member 320 carries load from the drawer 5*a* in use such that the drawer 5*a* remains in its horizontal position.

In FIG. 11*a* the first guiding rail 310 is shown in a view seen from the inside of the cabinet 3, while in FIG. 11*b* the first guiding rail 310 is shown in a view as seen through the wall of the cabinet 3. The sliding members 320, 350, of which the sliding member 350 is attached to the second guiding rail 340 (not shown in FIGS. 11*a-b*), are also shown for facilitating the understanding of the operation of the drawer sliding system 300.

A small stop member 316 protrudes downwards from the upper edge of the groove 315 at a position being set as the maximum pull-out length of the drawer 5*a*. When the sliding member 350, being fixedly attached to the second guiding rail 340 at the rear end of the drawer 5*a*, reaches the stop member 316 further horizontal movement is prevented unless the drawer 5*a* is tilted to allow dismounting of the drawer 5*a* from the cabinet 3.

Figure 12A:
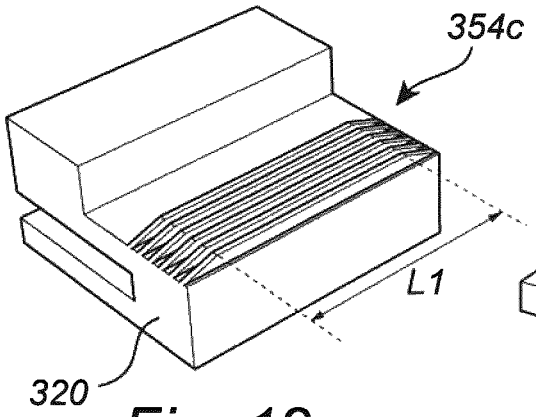
FIG. 12*a* is an isometric view of a second part of the sliding system shown in FIG. 10.
Figure 12B:
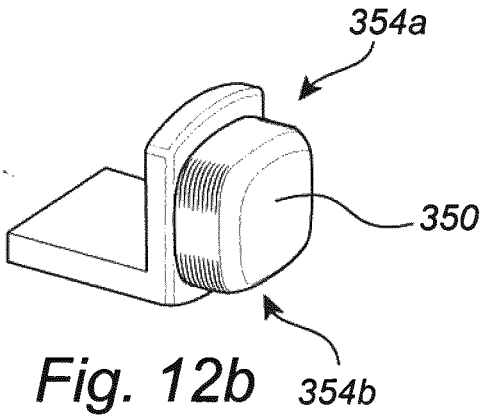
FIG. 12*b* is an isometric view of a third part of the drawer sliding system shown in FIG. 10.

In FIGS. 12*a-b* further details of the sliding members 320, 350 are shown. In FIG. 12*a* the sliding member 320 is shown, i.e. the sliding member 320 being fixedly attached to the front end of the first guiding rail 310 being mounted to the cabinet 3. An upper surface 322 is provided with protrusions 354*c* similar to the protrusions of the sliding member 220 described above and having a function according to the principles described hereinbefore, e.g. with reference to FIG. 5*b*. Hence, the protrusions 354*c* are intended for sliding against the sliding surface 342 of the second guiding rail 340. From FIG. 12*b* it is clear that the sliding member 350, i.e. the sliding member 350 being fixedly attached to the rear end of the second guiding rail 340 being mounted to the drawer 5*a*, is provided with upper and lower protrusions 354*a*, 354*b* for engaging with the upper and lower sliding surfaces 312, 314 of the first guiding rail 310, again according to the principles of FIG. 5*b*.

Figure 13A:
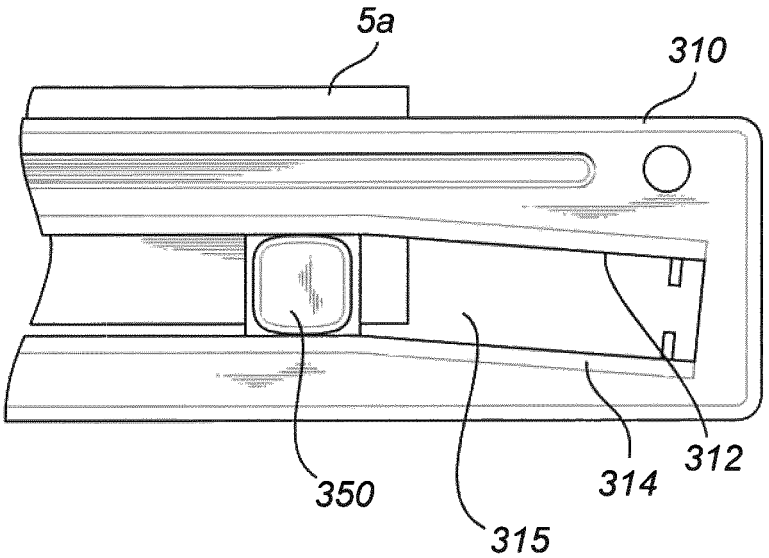
FIG. 13*a* is a side view of the drawer sliding system shown in FIG. 10 in a first position.
Figure 13B:
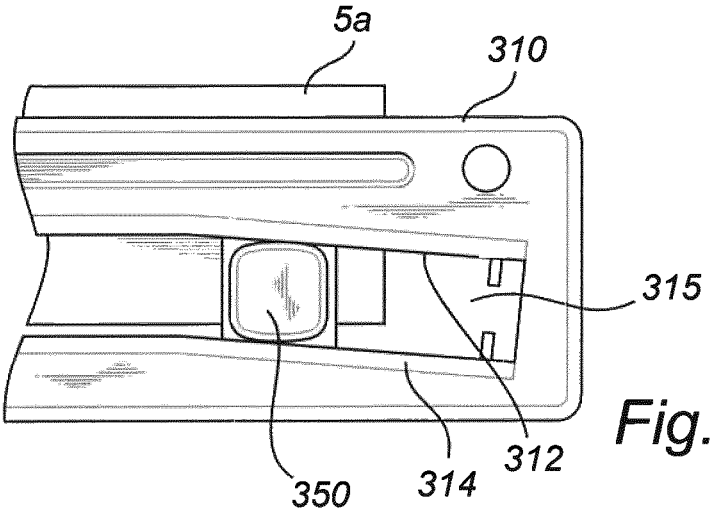
FIG. 13*b* is a side view of the drawer sliding system shown in FIG. 10 in a second position.

FIGS. 13*a-b* show the end portion of the groove 315 of the first guiding rail 310. The groove 315 has a rear end being tilted downwards thus allowing for a self-closing functionality of the sliding system 300. When the drawer 5*a* is pushed inwards to reach its closed position, the sliding member 350 will enter the tapered end part of the groove 315 and "fall" further inwards and downwards until the closed end position is reached.

Figure 14:
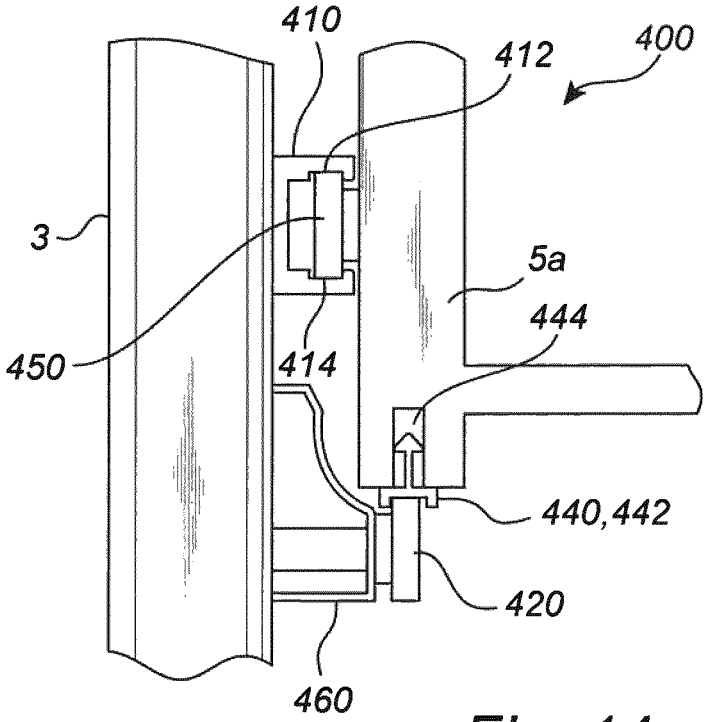
FIG. 14 is a cross-sectional view of a drawer sliding system according to a further embodiment.
Figure 15A:
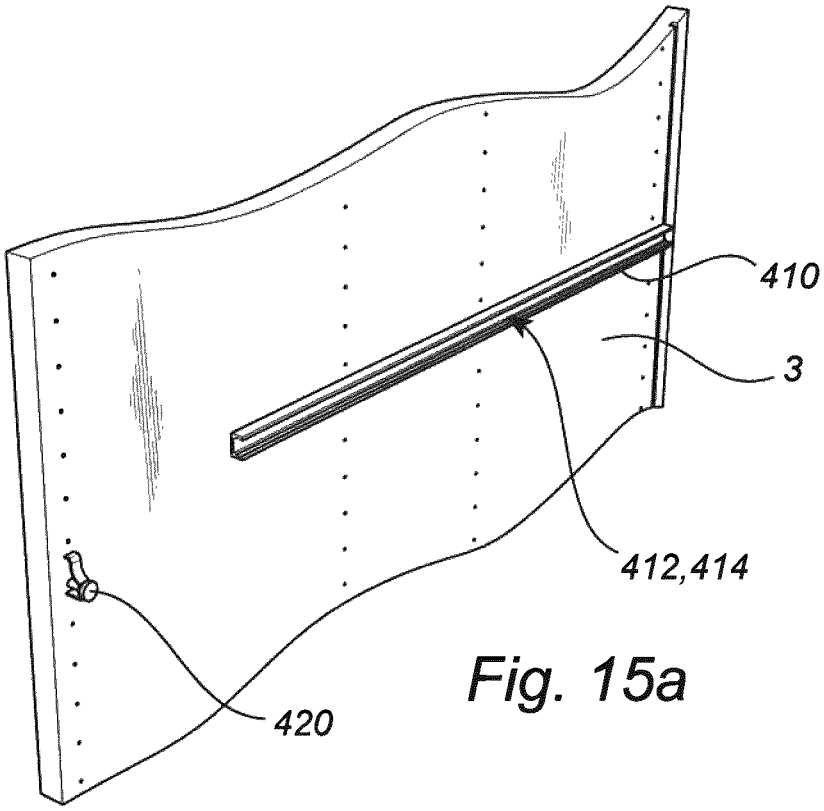
FIG. 15*a* is an isometric view of a cabinet and parts of the drawer sliding system shown in FIG. 14.
Figure 15B:
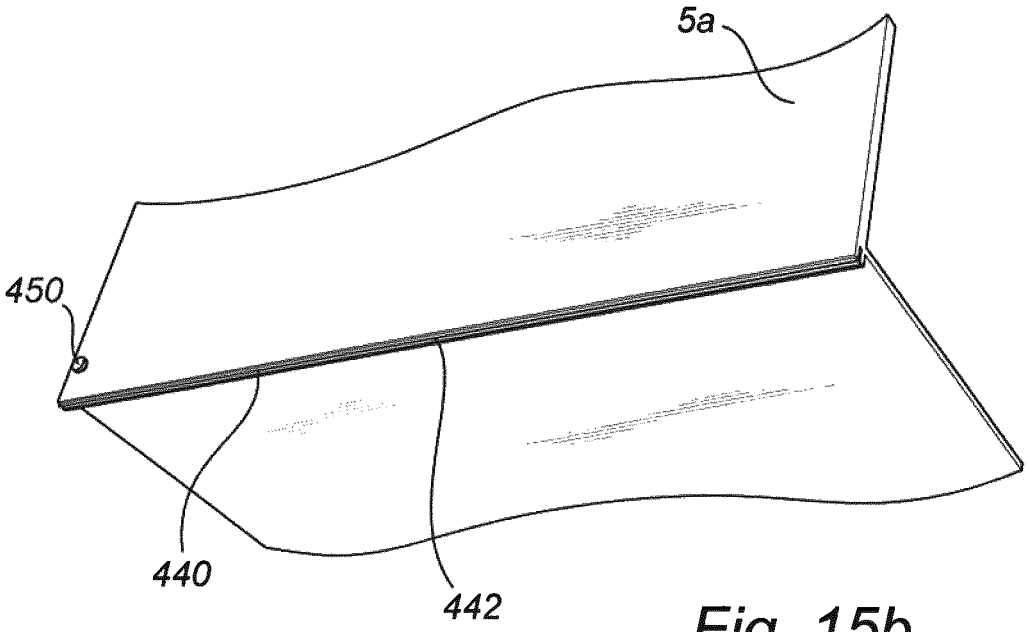
FIG. 15*b* is an isometric view of a drawer and parts of the drawer sliding system shown in FIG. 14.

In FIGS. 14, 15*a-b* another embodiment of a drawer sliding system 400 is shown. The drawer sliding system 400 is similar to the previously described sliding systems 200, 300 in that a first guiding rail 410 is attached to the inner wall of the cabinet 3, and a second guiding rail 440 is attached to the drawer 5*a*. The inner wall of the cabinet 3 is also provided with a sliding member 420 to engage with a sliding surface 442 of the second guiding rail 440, and the drawer 5*a* is also provided with a sliding member 450 to engage with sliding surfaces 412, 414 of the first guiding rail 410. The sliding member 450 is mounted at the rear end of the drawer 5*a*, as seen in FIG. 15*b*.

As can be seen from the figures the first guiding rail 410 is provided as a C-shaped member, having inner upper and inner lower sliding surfaces 412, 414. Accordingly, the drawer 5*a* is provided with a sliding member 450 configured to fit in the C-shaped member so that protrusions, or blades or points of contact (not shown, but preferably similar to what has been described hereinbefore with reference to FIG. 5*b*), engage with the respective inner upper and inner lower sliding surface 412, 414.

The second guiding rail 440 is vertically displaced from the first guiding rail 410; in this embodiment the second guiding rail 440 is positioned below the position of the first guiding rail 410. The second guiding rail 440 is configured as a metal strip or similar providing a sliding surface 442 at the bottom edge of the drawer 5*a*. The sliding surface 442 may e.g. be connected to the drawer 5*a* by means of a pushed-in piece 443, engaging with a longitudinal recess 444 in the bottom edge of the drawer 5*a*.

The sliding member 420, having protrusions, blades, or points of contact extending upwards (not shown, but preferably similar to what has been described hereinbefore with reference to FIG. 5*b*), is mounted on the inner wall of the cabinet 3, adjacent to the opening of the cabinet 3, as seen in FIG. 15*a*, and at a vertical position corresponding to the position of the second guiding rail 440. The sliding member 420 may optionally, as indicated in FIG. 14, be mounted to the inner wall of the cabinet 3 via a bracket 460. Preferably, both sliding members 420 and 450 are fixed and do not rotate as the respective sliding surface 442, 412, 414 slides thereover. Furthermore, when the drawer 5*a* is in its closed position, as in FIG. 1*a*, the sliding members 420, 450 will be located at their maximum distance from each other.

Figure 16A:
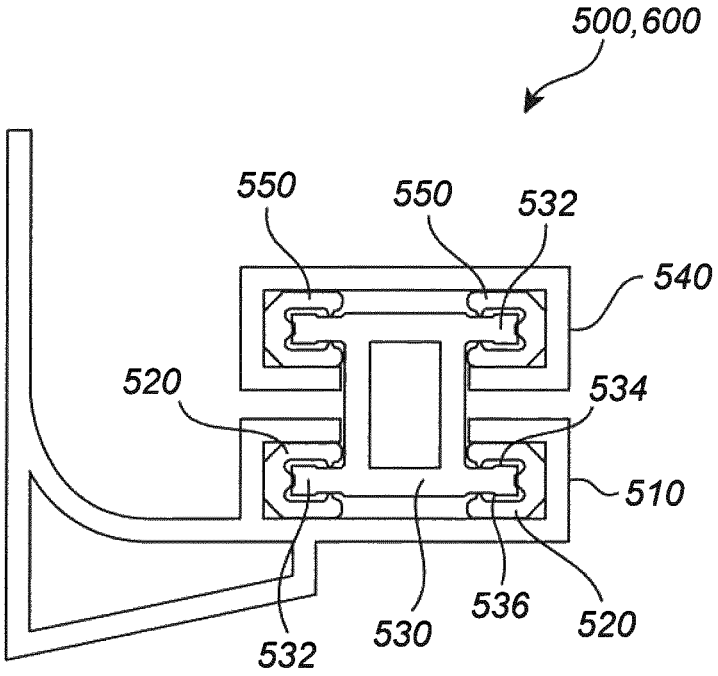
FIG. 16*a* is a cross-sectional view of a drawer sliding system according to a further embodiment.
Figure 16B:
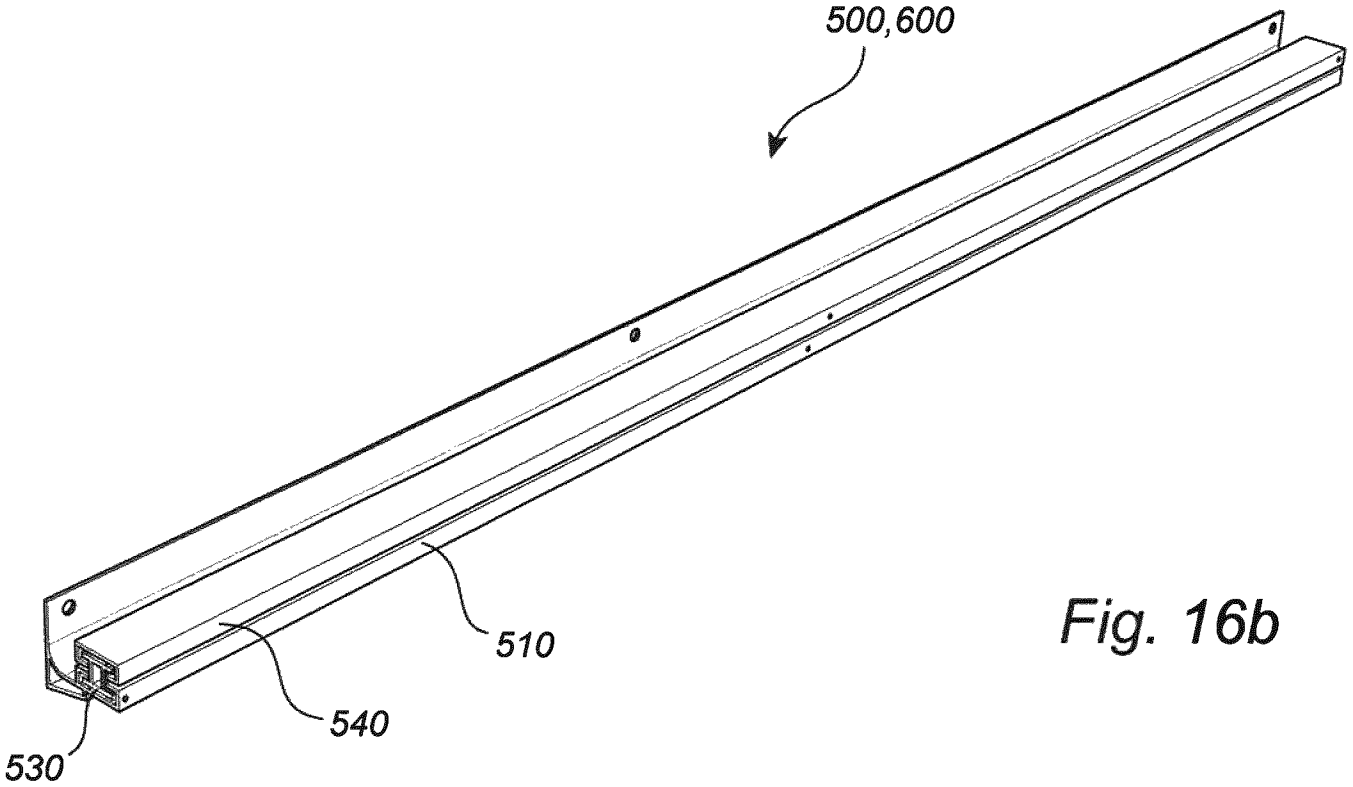
FIG. 16*b* is an isometric view of the drawer sliding system shown in FIG. 16*a;*

In FIGS. 16*a-b* other embodiments 500, 600 of drawer sliding systems are shown. The two embodiments share the same cross-section, however they operate according to different principles as will be described further on. These two embodiments allow for a full extension of the drawer 5*a*.

As can be seen in FIG. 16*a* the drawer sliding system 500, 600 has a first guiding rail 510 being attachable to an inner wall of a cabinet 3, a second guiding rail 540 being attachable to the drawer 5*a*, for example attachable to an underside of a drawer 5*a*, and an H-shaped intermediate slide bar 530 arranged in between the first and second guiding rails 510, 540. Pulling out the drawer 5*a* thus provides a sliding movement of the second guiding rail 540 and the intermediate slide bar 530 relative the first guiding rail 510. As for the previous embodiments the sliding system relies on the provision of sliding surfaces, and sliding members 520, 550 engaging with the sliding surfaces.

Figure 17A:
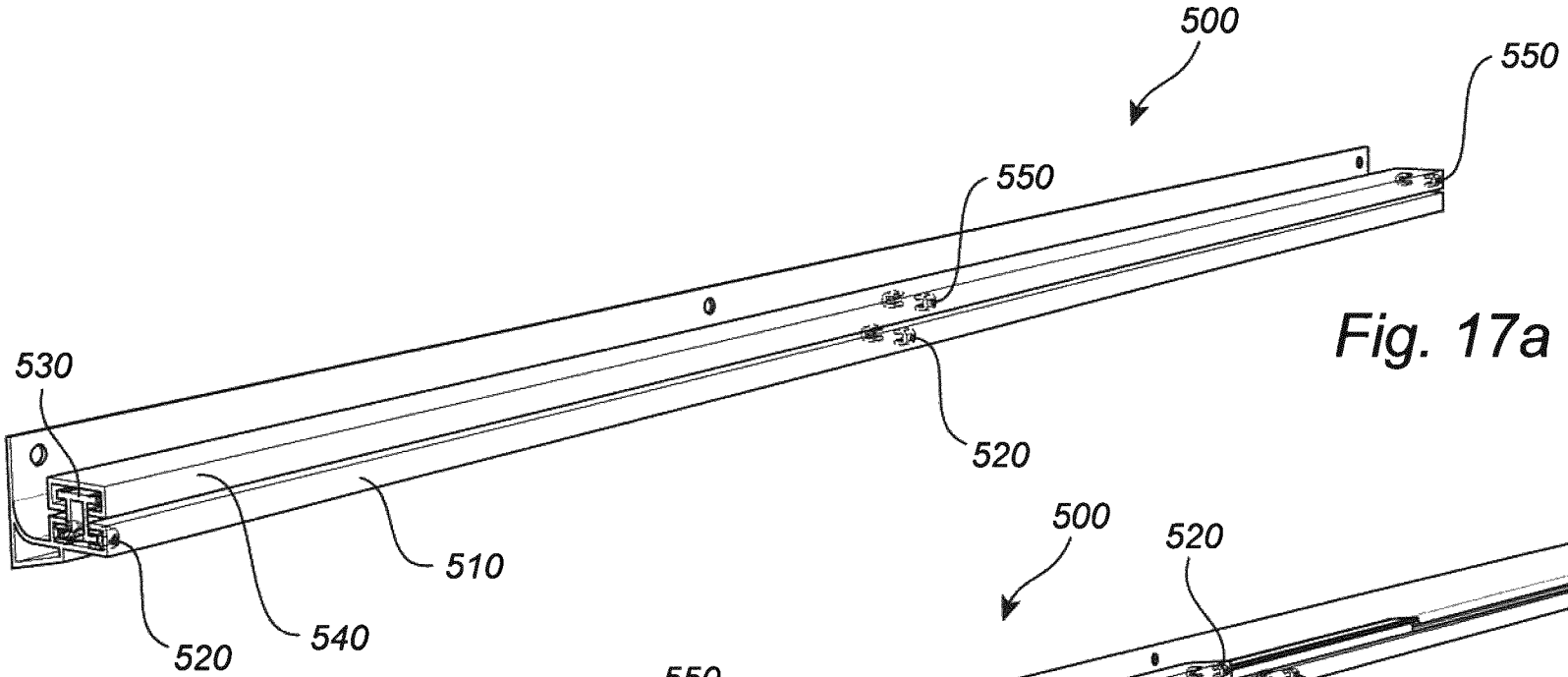
FIGS. 17*a-c* are isometric views of the drawer sliding system shown in FIG. 16*a*, shown in different operational states.
Figure 17B:
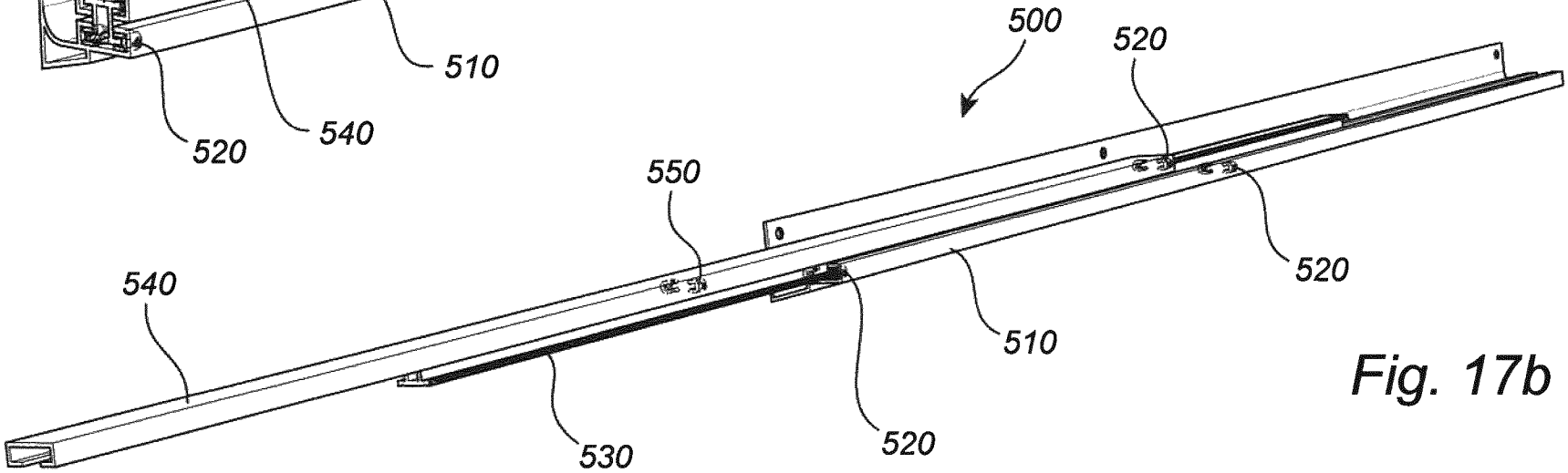
Figure 17C:
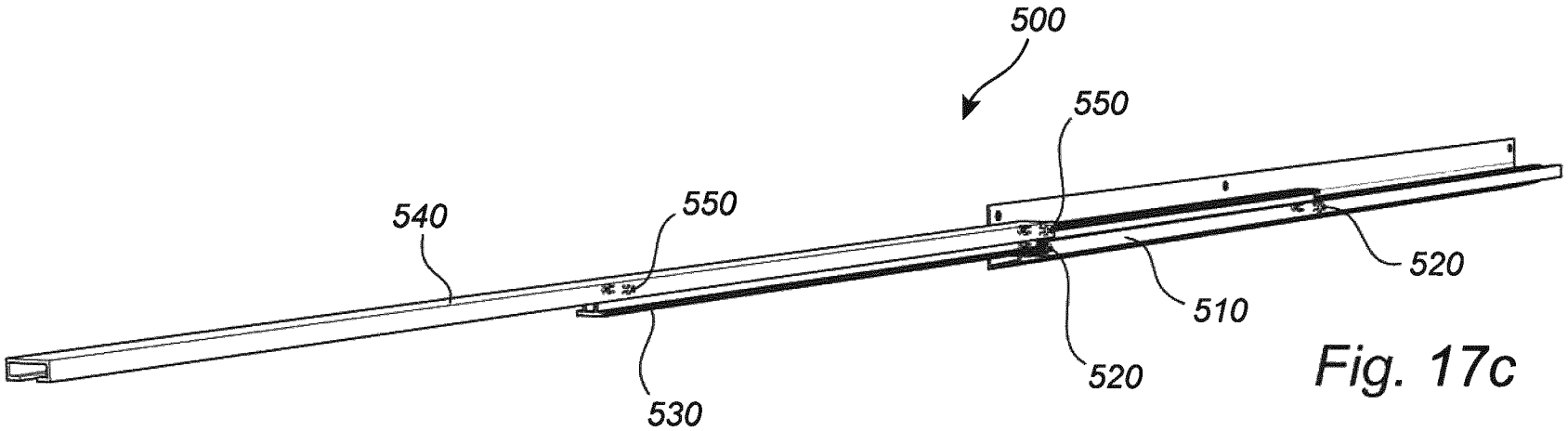

Now turning to FIGS. 17*a-c* the operation and exact configuration of the drawer sliding system 500 is shown. As can be seen in FIG. 17*a* the first guiding rail 510 is provided with two sets of sliding members 520 being secured to the first guiding rail 510 at a front position, and at a mid position, respectively. Each sliding member 520 forms a C-shape for receiving a respective horizontal protruding member 532 (see FIG. 16*a*) of the H-shaped intermediate slide bar 530. For the desired sliding action the sliding member 520 is provided with protrusions extending inwards, and towards upper and lower sliding surfaces 534, 536 of the respective horizontal protruding member 532 of the intermediate slide bar 530. Returning to FIG. 17*a*, the intermediate slide bar 530 may thus be drawn out from the position shown in FIG. 17*a* due to the sliding action between the intermediate slide bar 530 and the first guiding rail 510.

Similar to this, the second guiding rail 540 is also provided with sliding members 550. The sliding members 550 are provided as a first set, fixedly attached at a rear position of the second guiding rail 540, and a second set, fixedly attached at a mid position of the second guiding rail 540. The sliding members 550 are identical to the sliding members 520 of the first guiding rail 510, and hence the intermediate slide bar 530 also has upper horizontal protruding members 532 for providing upper and lower sliding surfaces, similar to the sliding surfaces 534, 536 of the lower protrusions 532, engaging with the sliding members 550. Each of the sliding members 520, 550 may have protrusions, blades, or points of contact according to the above description, for example according to the principles described with reference to FIG. 5*b*. Returning to FIG. 17*a*, the second guiding rail 540 may thus be drawn out from the position shown in FIG. 17*a* due to the sliding action between the second guiding rail 540 and the intermediate slide bar 530.

In operation, i.e., when pulling out a drawer 5*a* from the cabinet 3, the second guiding rail 540 is drawn out from the cabinet 3 and out from the first guiding rail 510; this pulling action will also cause a sliding action of the intermediate slide bar 530 relative the first guiding rail 510 and relative the second guiding rail 540. This position is shown in FIG. 17*b*. Upon further pull-out action the second guiding rail 540 will reach its most extended position relative the intermediate slide bar 530, and the intermediate slide bar 530 will reach its most extended position relative the first guiding rail 510. This position is shown in FIG. 17*c*.

Hence, the drawer sliding system 500 described in FIGS. 16*a-b* and 17*a-b* has all its sliding surfaces 534, 536 located on the intermediate slide bar 530. The first guiding rail 510 holds the sliding members 520 but has no sliding surfaces, and the second guiding rail 540 holds the sliding members 550 but has no sliding surfaces. This provides for a freedom of material choice and surface treatment for the first and second guiding rails 510, 540. The sliding members 520, 550 could have a design similar to that described in FIGS. 19*b* and 19*d* hereinbelow, and may include a plug 556 for fixing the respective sliding member 520, 550 in a correct position on the respective guiding rail 510, 540.

Figure 18A:
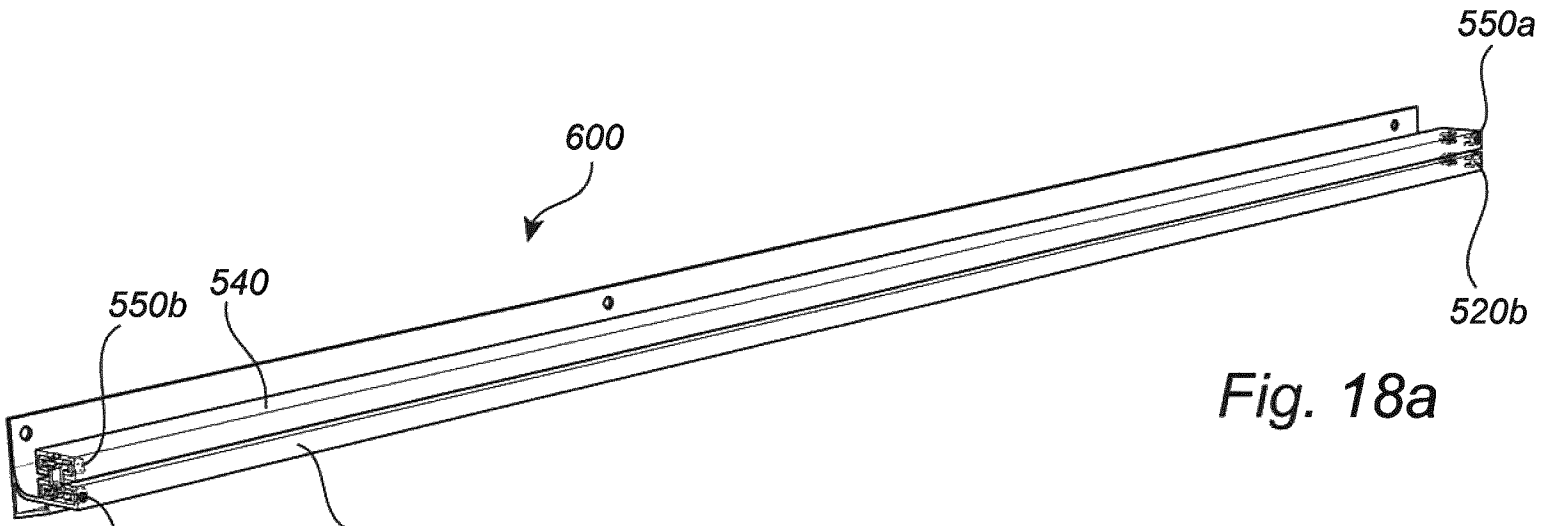
FIGS. 18*a-c* are isometric views of another embodiment of a drawer sliding system, shown in different operational states.
Figure 18B:
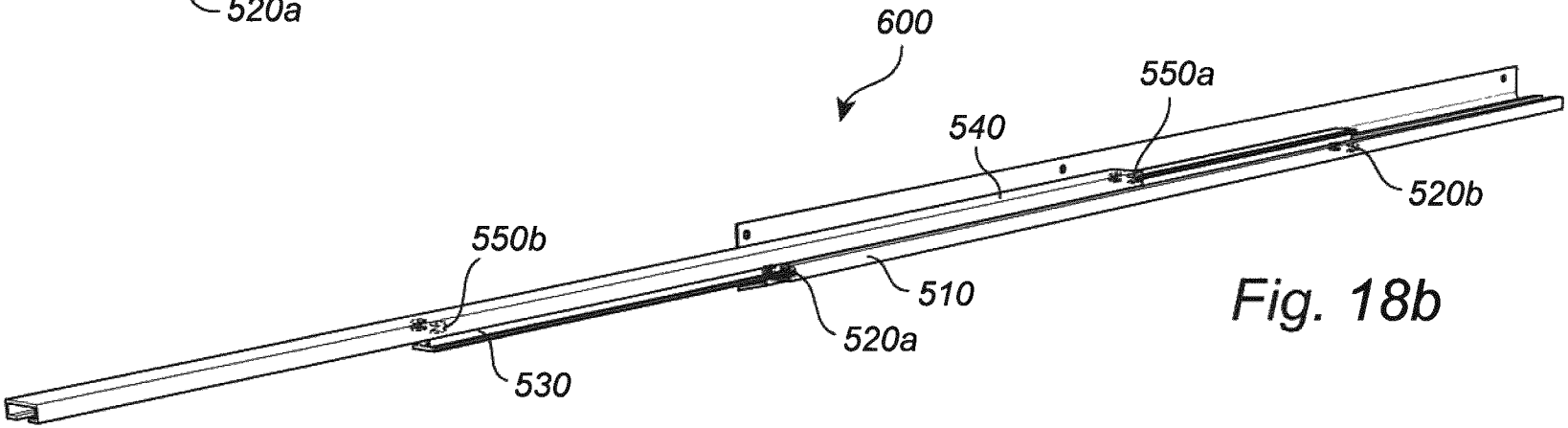
Figure 18C:
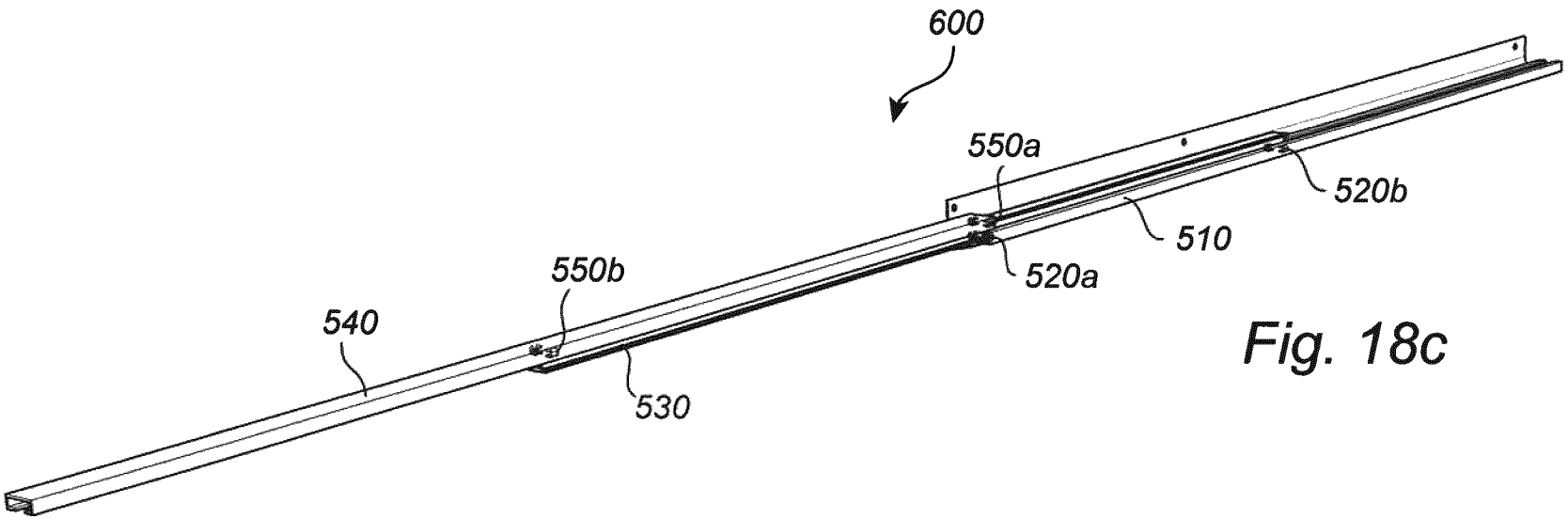

In FIGS. 18*a-c* the operation and exact configuration of the drawer sliding system 600 is shown. As can be seen in FIG. 18*a* the connection between the first guiding rail 510 and the intermediate slide bar 530 involves the first guiding rail 510 being provided with a first set of sliding members 520*a* and the intermediate slide bar 530 being provided with a second set of sliding members 520*b*. The first set of sliding members 520*a* is secured to the first guiding rail 510 at a front position, and the second set of sliding members 520*b* is fixedly attached to a rear part of the intermediate slide bar 530. Each sliding member 520*a-b* forms a C-shape for receiving a respective horizontal protruding member 532 (similar to the protruding member 532 illustrated in FIG. 16*a*) of the H-shaped intermediate slide bar 530. For the desired sliding action the sliding member 520*a* is provided with protrusions extending inwards, and towards upper and lower sliding surfaces 534, 536 of the respective horizontal protruding member 532 of the intermediate slide bar 530. However the sliding member 520*b* is provided with upper and lower protrusions, blades, or points of contact extending outwards to engage with respective sliding surfaces of the first guiding rail 510. The intermediate slide bar 530 may thus be drawn out from the position shown in FIG. 18*a* due to the sliding action between the intermediate slide bar 530 and the first guiding rail 510.

Similar to this, the connection between the second guiding rail 540 and the intermediate slide bar 530 involves the second guiding rail 540 being provided with a first set of sliding members 550*a* and the intermediate slide bar 530 being provided with a second set of sliding members 550*b*. The first set of sliding members 550*a* is fixedly attached at a rear position of the second guiding rail 540, and the second set of sliding members 550*b* is fixedly attached at a front part of the intermediate slide bar 530. The sliding members 550*a-b* are identical to the sliding members 520*a-b*, meaning that the sliding member 550*b* is provided with upper and lower protrusions, blades, or points of contact extending outwards to engage with respective sliding surfaces of the second guiding rail 540. The second guiding rail 540 may thus be drawn out from the position shown in FIG. 18*a* due to the sliding action between the intermediate slide bar 530 and the second guiding rail 540.

In operation, i.e., when pulling out a drawer 5*a* from the cabinet 3, the second guiding rail 540 is drawn out from the cabinet 3 and the first guiding rail 510; this pulling action will also cause a sliding action of the intermediate slide bar 530 relative the first guiding rail 510. This position is shown in FIG. 18*b*. Upon further pull-out action the second guiding rail 540 will reach its most extended position relative the intermediate slide bar 530, and the intermediate slide bar 530 will reach its most extended position relative the first guiding rail 510. This position is shown in FIG. 18*c*.

Hence, the drawer sliding system 600 described in FIGS. 18*a-c* has sliding surfaces located on all three of the first guiding rail 510, the intermediate slide bar 530, and the second guiding rail 540. The first guiding rail 510 holds, in fixed manner, the sliding members 520*a*, the intermediate slide bar 530 holds, in a fixed manner, the sliding members 520*b* and 550*b*, and the second guiding rail 540 holds, in a fixed manner, the sliding members 550*a*.

Figure 19A:
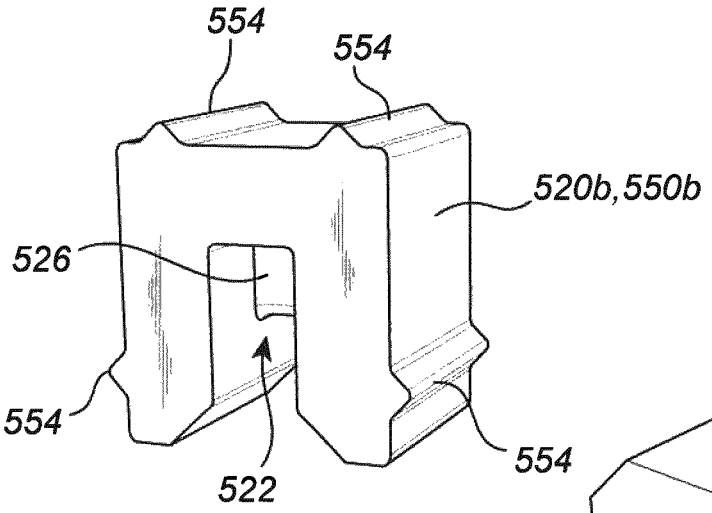
FIGS. 19*a-d* are isometric views of sliding system parts of the drawer sliding system shown in FIG. 16*a*.
Figure 19B:
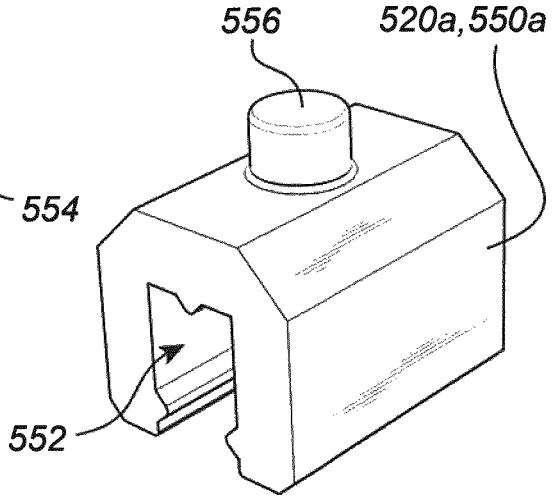
Figure 19C:
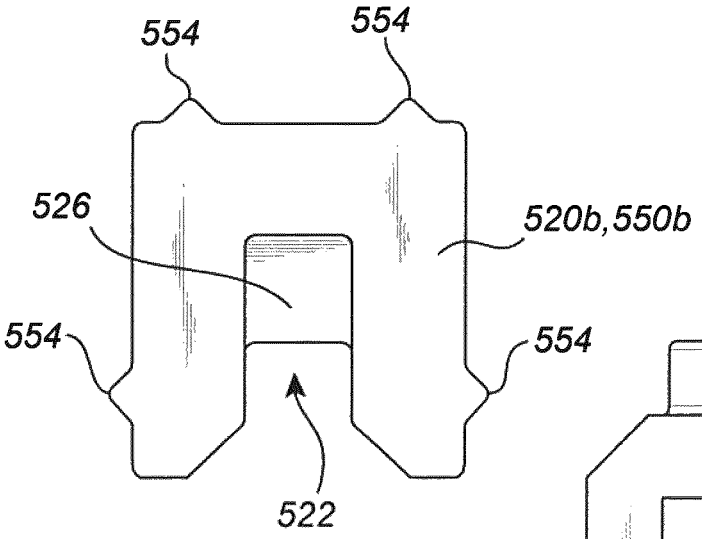

In FIGS. 19*a* and 19*c* the respective sliding member 520*b*, 550*b* is shown in more detail. This sliding member 520*b*, 550*b* is adapted to be fixed to the intermediate slide bar 530 to provide a low friction contact with sliding surfaces of the first or second guiding rail 510, 540 as explained above. The sliding member 520*b*, 550*b* has a recess 522 for receiving the horizontal protruding member 532 of the intermediate slide bar 530, and outwardly directed protrusions 554 for creating the points of contact with the sliding surfaces of the first or second guiding rails 510, 540. The protrusions 554 provide both horizontal and vertical guiding of the intermediate slide bar 530. The recess 522 may be provided with fixing means, such as a stopper 526, for fixing the sliding member 520*b*, 550*b* to the protruding member 532 of the intermediate slide bar 530.

Figure 19D:
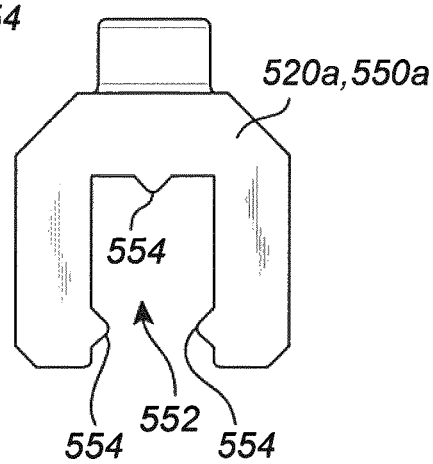

In FIGS. 19*b* and 19*d* the respective sliding member 520*a*, 550*a* is shown. This sliding member 520*a*, 550*a* is used to provide a low friction contact with sliding surfaces of the intermediate slide bar 530 as explained above. The sliding member 520*a*, 550*a* has a recess 552 for receiving the horizontal protruding member 532 of the intermediate slide bar 530, and inwardly directed protrusions 554 for creating the points of contact with the sliding surfaces of the intermediate slide bar 530. The protrusions 554 provide both horizontal and vertical guiding of the first and second guiding rails 510, 540.

A plug 556 may be provided on the sliding member 520*a*, 550*a* being configured to be pressed into a mating hole of the first or second guiding rail 510, 540. This facilitates mounting of the sliding member 520*a*, 550*a* to the respective guiding rail 510, 540.

The embodiments described above all share the same common concept of allowing a draw-out functionality of a drawer by means of a sliding system having at least one sliding surface, and sliding members interacting with the sliding surface in a low friction sliding manner.

Furthermore there is, according to an embodiment, provided a method for providing a sliding surface 132, 134, 136, 138 for a sliding system 100, 200, 300, 400, 500, 600. In such a method there is provided a sliding surface 132, 134, 136, 138 having a slide surface coated with a lacquer comprising a resin. In order to provide the sliding surface 132, 134, 136, 138 with lowered friction, the lacquer is, at least partly, coated with a lipophilic composition coating. Aspects of the sliding surface 132, 134, 136, 138, the lacquer, and the lipophilic composition coating have been provided herein above and are applicable to this embodiment as well. In applying the lipophilic composition to provide the lipophilic composition coating, the lipophilic composition may firstly be heated, such as melted, to reduce its viscosity. Further, the lipophilic composition may be dissolved in a solvent to facilitate application. After application, the solvent may be evaporated, at least partly. The lipophilic composition to provide the lipophilic composition coating may be applied in various ways, such as by spraying, smearing, painting, coating, spreading etc.

According to an embodiment, the lipophilic composition is applied by the end-consumer. Thus, the sliding surface 132, 134, 136, 138, the sliding system 100, 200, 300, 400, 500, 600 or arrangements comprising the sliding surface 132, 134, 136, 138 may be provided together with a lipophilic composition to be applied by the end-consumer, i.e. the lacquer is un-coated upon delivery.

Similarly, another embodiment relates to the use of such a lipophilic composition, as described herein as an irreversibly bound lubricant for a sliding surface 132, 134, 136, 138. By "irreversibly bound lubricant" is, according to an embodiment, meant that the lubricant is not removed from the slide surface 132, 134, 136, 138 during normal operation of the sliding system 100, 200, 300, 400, 500, 600 and that it cannot be easily removed using mechanical means, e.g. it cannot be removed by wiping the slide surface with a cloth. As described herein, the sliding surface 132, 134, 136, 138 is coated with a lacquer comprising a resin. Aspects of the sliding surface 132, 134, 136, 138, the lacquer, and the lipophilic composition coating have been provided herein above and are applicable to this embodiment as well.

Without further elaboration, it is believed that one skilled in the art may, using the preceding description, utilize the present invention to its fullest extent. The preceding preferred specific embodiments are, therefore, to be construed as merely illustrative and not limitative of the disclosure in any way whatsoever.

EXAMPLES

The following examples are mere examples and should by no means be interpreted to limit the scope of the invention, as the invention is limited only by the accompanying claims.

General

All chemicals were obtained from Sigma-Aldrich. In providing mixtures, e.g. palmitic acid 10 mass % in liquid paraffin, the two compounds (e.g. 3 g palmitic acid and 27 g liquid paraffin) were mixed under heating to melt the mixture. Further, the mixtures were applied to the sliding surface 132, 134, 136, 138 before solidifying.

The test procedure used was based on SS-EN 14882:205. In short, a sled with parallel plastic blades (four in total; two along each longitudinal slide axis) of POM was positioned on an anodized aluminum profile having been anaphoretically coated with an acrylic resin and subsequently heat cured to provide a lacquered slide surface. Aluminum profiles lacquered in this way are for example provided by Sapa Profiler AB, 574 38 Vetlanda, Sweden, and are marketed under the trade name SAPA HM-white, the materials being produced using the Sapa HM-white method which is based on the above referenced Honny method. In the friction measurements, the sled was pulled over the slide bar at a constant speed of 500 mm/min and the force necessary to pull the sled was registered using an Instron 5966 tension testing system. The total weight of the sled corresponds to 10 N. Fresh profiles were used for each lipophilic composition, as the lipophilic compositions cannot be removed once applied. However, the profiles were re-used after the control experiments (no lipophilic compositions applied), washing and ageing, respectively.

Example 1

By using the test procedure described above, the resulting friction from application of various lipophilic compositions to anodized, lacquered aluminum profiles was determined. The resulting dynamic friction, mean value from three test sequences, was registered and compared to the dynamic friction for anodized aluminum profiles provided with a lacquer but not coated with any lipophilic composition (=control). The results are provided in Table 1 and 2 below.

TABLE 1

Fatty acids in liquid paraffin

| Lipophilic composition | Wash | Ageing | Dynamic friction Mean (n = 3) |
|---|---|---|---|
| No (control) | — | — | 0.214 |
| MA5% | — | — | 0.049 |
| MA10% | — | 3 days | 0.046 |
| MA30% | — | — | 0.049 |
| MA10% | Yes | — | 0.041 |
| PA10% | — | 3 days | 0.047 |
| PA10% | Yes | — | 0.042 |
| SA10% | — | 3 days | 0.050 |
| SA10% | Yes | — | 0.044 |
| LP | — | 3 days | 0.053 |
| LP | Yes | — | 0.050 |

MA5%/10%/30% = Myristic acid 5/10/30 mass % in liquid paraffin
PA10% = Palmitic acid 10 mass % in liquid paraffin
SA10% = Stearic acid 10 mass % in liquid paraffin
LP = Liquid paraffin

TABLE 2

Triglycerides in liquid paraffin

| Lipophilic composition | Wash | Ageing | Dynamic friction Mean (n = 3) |
|---|---|---|---|
| No (control) | — | — | 0.214 |
| TM10% | — | — | 0.0510 |
| TM10% | Yes | — | 0.0524 |
| TP10% | — | 3 days | 0.0454 |
| TP10% | — | 6 weeks | 0.0513 |
| TP10% | Yes | — | 0.0440 |
| TS10% | — | — | 0.0524 |
| TS10% | Yes | — | 0.0504 |
| LP | — | — | 0.053 |
| LP | Yes | — | 0.050 |

TM10% = Trimyristate 10 mass % in Liquid paraffin
TP10% = Tripalmitate 10 mass % in Liquid paraffin
TS10% = Tristearate 10 mass % in Liquid paraffin
LP = Liquid paraffin

TABLE 3

Fatty acids in liquid paraffin

| Lipophilic composition | Wash | Dynamic friction Mean (n = 3) |
|---|---|---|
| LP | — | 0.054 |
| LP | Yes | 0.042 |
| LA10% | — | 0.058 |
| LA 10% | Yes | 0.041 |
| LA 30% | — | 0.046 |
| LA 30% | Yes | 0.039 |
| LA 50% | — | 0.048 |
| LA 50% | Yes | 0.036 |
| LA 70% | — | 0.041 |
| LA 70% | Yes | 0.036 |
| Coconut oil | — | 0.033 |
| Coconut oil | Yes | 0.037 |

LA10/30/50/70% = Lauric acid 10/30/50/70 mass % in Liquid paraffin

As can be seen from Table 1 and 2, the resulting dynamic friction was reduced by about 75% by applying a lipophilic compositions to the anodized aluminum profiles, though the initial dynamic friction of the un-coated anodized aluminum profiles not was that high. Furthermore, whereas the dynamic friction remained low and nearly the same for the coated profiles over repeated cycles, the dynamic friction for un-coated anodized aluminum profiles was significantly increased (seizing) already after less than 20 test cycles.

It can also be seen from the above tables 1 and 2 that the tests including fatty acids or triglycerides resulted in a somewhat lower friction compared to pure Liquid paraffin, in particular when the fatty acid is myristic acid or palmitic acid, and when the triglyceride is tripalmitate. Coconut oil, being a mixture of various triglycerides, in which lauric acid is the most common fatty acid residue, provided very low friction (cf. Table 3). Further, neither ageing nor washing (wiping by a wet cloth 6 times, followed by wiping 4 times with a dry cloth) had any significant effect on the dynamic friction.

Example 2

By using the test procedure described above, the resulting friction at various loads (5, 10 and 20 N, respectively) using liquid paraffin as the lipophilic composition coating was determined. Increasing the load did not result in increased friction. On the contrary, the lowest load (5 N) displayed the highest friction (0.052 (at 5N) vs. 0.045 (at 10 N)/0.046 (at 20 N)).

Example 3

In an additional experiment, a corresponding aluminum bar, but without any lacquer, was used. Use of palmitic acid 10 mass % in liquid paraffin as lubricant on the non-lacquered bar resulted in a dynamic friction of 0.1132, i.e. more than 100% higher than corresponding dynamic friction obtained with the lacquered aluminum bar (cf. Table 1; 0.042 and 0.047, respectively).

Example 4

In additional examples also steel profiles as well as other lacquers were evaluated.

Lacquers: Teknotherm 4400 (Teknos)—wet spray lacquer, Standofleet® (Standox) wet spray lacquer, Powercron® 6200HE (PPG)—cationic epoxy electrocoat, Interpon AF (AkzoNobel)—powder coating, and Alesta® (Axalta)—powder coating.

Profiles: Aluminium (Al), and steel (Fe)

TABLE 4

Coconut oil on aluminum and steel profiles

| Lacquer | Profile | Dynamic friction Mean (n = 3) | Profile | Dynamic friction Mean (n = 3) |
|---|---|---|---|---|
| Teknotherm | Al | 0.040 | Fe | 0.050 |
| Standofleet | Al | 0.045 | Fe | 0.048 |
| Interpon AF | Al | 0.024 | Fe | 0.034 |
| Powercron | Al | 0.021 | Fe | 0.041 |
| Alesta | Al | 0.025 | Fe | 0.038 |

As can be seen from Table 4, the aluminum profiles displayed lower friction than the steel profiles though also the steel profiles displayed a very low friction. Further, whereas some of the alternative lacquers displayed comparable or lower friction than the SAPA HM-white profiles (dynamic friction mean: 0.033), the wet lacquered profiles displayed slightly higher friction. Without being bond to any theory, this may be due to wet lacquered profiles inherently having somewhat thicker lacquer and/or varying thickness of the lacquer. Further, in comparing coconut oil and liquid paraffin (data not shown) it was seen that coconut oil generally provided somewhat lower friction.

Example 5

Tests were also performed in a full-scale test rig using a wardrobe door with a weight of 8.5 kg and using two sliding members 120, 150 and a sliding surface 132, 134, 136, 138. When applying a lipophilic composition coating comprising 100% Liquid paraffin to the lacquer of the sliding surface 132, 134, 136, 138 the wardrobe door could still be moved back and forth without problems and at still a low friction after 500 000 cycles of reciprocation of the wardrobe door. In a comparative test the same equipment was used, but without any lipophilic composition coating being applied on the lacquer. In the latter case the tests had to be stopped already after less than 30 cycles as the test equipment was about to break down due to rapidly increasing friction between the sliding members 120, 150 and the sliding surface 132, 134, 136, 138 (seizing).

It should be realized that the embodiments described above are not limited by the exact number and dimensions described herein. Drawers could be provided using even more moveable parts.

Although the present invention has been described above with reference to specific embodiments, it is not intended to be limited to the specific form set forth herein. Rather, the invention is limited only by the accompanying claims.

The invention claimed is:

1. A drawer sliding system for a drawer, comprising at least two parts being moveable relative each other and adapted for together forming a connection between the drawer and an associated cabinet, wherein a first part of said at least two parts comprises at least one sliding surface being coated with a lacquer comprising a resin, wherein said lacquer in turn is at least partly coated with a lipophilic composition coating to provide a slide layer with a lowered friction, wherein a second part of said at least two parts is provided with at least one sliding member, an interface between the at least one sliding surface and the at least one sliding member forming a linear plain bearing to allow for linear movement of the at least one sliding member along a longitudinal axis of the at least one sliding surface, wherein at least a part of said at least one sliding member being in contact with the at least one sliding surface is made of a plastic.

2. The sliding system according to claim 1, wherein the at least one sliding surface is formed on a guiding rail, said guiding rail forming one of said at least two parts.

3. The sliding system according to claim 2, wherein said guiding rail is provided with at least two opposite said sliding surfaces located at a vertical distance therebetween.

4. The sliding system according to claim 1, wherein the at least one sliding surface is formed by an intermediate slide bar providing a sliding movement in relation to at least one guiding rail, said at least one guiding rail forming one of said at least two parts.

5. The sliding system according to claim 1, wherein the at least one sliding surface is formed in a C-shaped groove in one of said at least two parts.

6. The sliding system according to claim 1, wherein the at least one sliding surface is formed on a protruding member having at least one of an upper sliding surface, a lower sliding surface, and a distal sliding surface.

7. The sliding system according to claim 1, wherein at least the part of said at least one sliding member being in contact with the at least one sliding surface is made of a plastic comprising a polymer with polar groups, wherein the polar groups are selected from the group consisting of hydroxyl groups, carboxylic acid groups, amide groups, halide groups, sulfide groups, cyano groups (nitrile groups), carbamate groups, aldehyde groups, and/or ketone groups.

8. The sliding system according to claim 1, wherein at least the part of said at least one sliding member in contact with the at least one sliding surface is made of a plastic comprising a polymer selected from the group of polymers consisting of polyoxymethylenes (POM), polyesters, polyamides (PA), polyvinyl chloride (PVC), polyphenylene sulfide (PPS), polyaryletherketone (PAEK), and Polytetrafluoroethylene (PTFE).

9. The sliding system according to claim 1, wherein said at least one sliding member is entirely made from a plastic.

10. The sliding system according to claim 1, wherein the part of said at least one sliding member being in contact with the at least one sliding surface is configured as a blade extending in the sliding direction and wherein the at least one sliding surface is present on a guiding rail forming one of the at least two parts of the sliding system, wherein the length of the blade, as seen along the sliding direction of the guiding rail, is 2-50 mm.

11. The sliding system according to claim 1, wherein the at least one sliding member comprises at least one individual contact point in contact with the at least one sliding surface, a contact area of each said individual contact point being less than 3 $mm^2$.

12. The sliding system according to claim 1, wherein the at least two parts being moveable relative each other comprise a first guiding rail being attached to an inner wall of a cabinet, and a second guiding rail being attached to the drawer, wherein optionally the sliding system further comprises an intermediate slide bar being movable relative to the first and second guiding rails, and wherein optionally the intermediate slide bar is provided with a first sliding surface being in sliding contact with a first slide member on the first guide rail and a second sliding surface being in sliding contact with a second slide member on the second guide rail, and/or is provided with a first slide member being in sliding contact with a first sliding surface on the first guide rail and a second sliding member being in sliding contact with a second sliding surface on the second guiding rail.

13. The sliding system according to claim 1, wherein the first part of said at least two parts is a guiding rail being provided with the at least one sliding surface, the second of said at least two parts being the at least one sliding member, wherein the guiding rail is provided with a groove receiving the at least one sliding member, the at least one sliding surface being provided inside said groove, wherein both upper and lower edges of the groove are provided with respective sliding surfaces being in sliding contact with upper and lower parts of the at least one sliding member.

14. The sliding system according to claim 1, wherein the at least one sliding surface is made from a material having a Vickers hardness of at least 50 MPa.

15. The sliding system according to claim 1, wherein the resin of the lacquer comprises polar groups selected from among hydroxyl groups, carboxylic acid groups, amide groups, cyano groups (nitrile groups), halide groups, sulfide groups, carbamate groups, aldehyde groups, and/or ketone groups.

16. The sliding system according to claim 1, wherein the at least one sliding surface is formed by an aluminum member having a surface onto which the lacquer is applied, the aluminum member having an anodized oxide surface layer onto which the lacquer is applied, wherein the thickness of the anodized oxide surface layer is at least 5 micrometers, and wherein the surface of the aluminum member has been electrophoretically coated with said resin and subsequently heat cured to form the lacquer coated on the at least one sliding surface.

17. The sliding system according to claim 1, wherein the lipophilic composition coating comprises compounds comprising C6 to C40 non-aromatic hydrocarbyl groups, wherein optionally the lipophilic composition coating present on the lacquer comprises at least 25 wt. % of compounds comprising C6 to C40 alkyl groups, and/or wherein optionally the lipophilic composition coating present on the lacquer comprises at least 25 wt. % C6 to C40 non-aromatic hydrocarbons.

18. The sliding system according to claim 1, wherein the lipophilic composition coating present on the lacquer comprises triglycerides and/or fatty acids; wherein optionally the lipophilic composition coating present on the lacquer comprises 1 to 40 wt. % triglycerides and/or fatty acids and wherein optionally the lipophilic composition coating present on the lacquer comprises at least 25 wt. % of triglycerides and/or fatty acids.

19. A drawer, comprising at least one said drawer sliding system according to claim 1.

20. The drawer according to claim 19, wherein one of said at least two parts is a first guiding rail being connected to an associated cabinet, while a second of said at least two parts is a second guiding rail being connected to the drawer, wherein the at least one sliding surface being arranged on one of the first and second guiding rails, and at least one sliding member being arranged on a second of the first and second guiding rails.

* * * * *